US009181739B2

(12) United States Patent
Baer

(10) Patent No.: US 9,181,739 B2
(45) Date of Patent: Nov. 10, 2015

(54) ADJUSTABLE DOOR MOUNTING SYSTEM

(75) Inventor: Austin R. Baer, Sarasota, FL (US)

(73) Assignee: Von Duprin LLC, Carmel, IN (US)

( * ) Notice: Subject to any disclaimer, the term of this patent is extended or adjusted under 35 U.S.C. 154(b) by 0 days.

(21) Appl. No.: 13/144,345

(22) PCT Filed: Jan. 21, 2010

(86) PCT No.: PCT/US2010/021618

§ 371 (c)(1),
(2), (4) Date: Aug. 5, 2011

(87) PCT Pub. No.: WO2010/085544

PCT Pub. Date: Jul. 29, 2010

(65) Prior Publication Data

US 2011/0283624 A1 Nov. 24, 2011

Related U.S. Application Data

(60) Provisional application No. 61/146,507, filed on Jan. 22, 2009, provisional application No. 61/253,957, filed on Oct. 22, 2009.

(51) Int. Cl.

| | |
|---|---|
| ***E05D 7/04*** | (2006.01) |
| ***E05D 3/12*** | (2006.01) |
| ***E05D 5/02*** | (2006.01) |
| ***E05D 7/00*** | (2006.01) |

(52) U.S. Cl.

CPC *E05D 7/04* (2013.01); *E05D 3/122* (2013.01); *E05D 5/0238* (2013.01); *E05D 7/009* (2013.01); *E05Y 2900/132* (2013.01)

(58) Field of Classification Search

CPC ..... E05D 7/04; E05D 5/0238; E05D 7/009; E05D 3/122

USPC ..... 49/381, 397–399, 501, 505, 400, 401; 16/236, 237, 382

See application file for complete search history.

(56) References Cited

U.S. PATENT DOCUMENTS

| | | | | | |
|---|---|---|---|---|---|
| 2,615,194 | A | * | 10/1952 | Kreiner | 16/248 |
| 3,263,368 | A | * | 8/1966 | Hildum et al. | 49/382 |
| 4,304,027 | A | * | 12/1981 | Di Fazio | 16/249 |
| 4,553,286 | A | * | 11/1985 | Schwarz, II | 16/382 |
| 4,881,296 | A | * | 11/1989 | Marinoni | 16/237 |
| 5,392,565 | A | * | 2/1995 | Rentschler | 49/504 |

(Continued)

OTHER PUBLICATIONS

International Search Report and Written Opinion dated Mar. 23, 2010, in PCT/US2010/021618.

*Primary Examiner* — Katherine Mitchell
*Assistant Examiner* — Marcus Menezes
(74) *Attorney, Agent, or Firm* — IpHorgan Ltd.

(57) ABSTRACT

A three-dimensional adjustable door mounting system and method for aligning and installing a hinged door within a frame. In one embodiment, the mounting system includes one or more captive nuts mounted to the door. The captive nut includes a movable adjusting plate retained by a stationary holding bracket mounted to the door. A threaded fastener inserted through a hinge door leaf and into the adjusting plate allows an installer to move and adjust the position of the hinge relative to the door in a first plane. In other embodiments, captive nuts may further be affixed to the door frame. A threaded fastener inserted through a hinge frame leaf and into the adjusting plate allows an installer to move and adjust the position of the hinge and door relative to the frame in a second plane different than the first plane.

16 Claims, 19 Drawing Sheets

(56) References Cited

U.S. PATENT DOCUMENTS

| | | | | | |
|---|---|---|---|---|---|
| 5,472,271 | A * | 12/1995 | Bowers et al. | 312/329 |
| 5,752,291 | A * | 5/1998 | Snyder | 16/235 |
| 6,152,554 | A * | 11/2000 | Parisi | 312/405 |
| 6,158,086 | A * | 12/2000 | De Souza | 16/247 |
| 2004/0163212 | A1 | 8/2004 | Isele | |
| 2006/0026796 | A1 * | 2/2006 | Hoffmann et al. | 16/237 |
| 2006/0260096 | A1 * | 11/2006 | Fries | 16/246 |
| 2007/0028420 | A1 * | 2/2007 | Lueffe et al. | 16/382 |
| 2007/0261201 | A1 * | 11/2007 | Baer et al. | 16/236 |

* cited by examiner

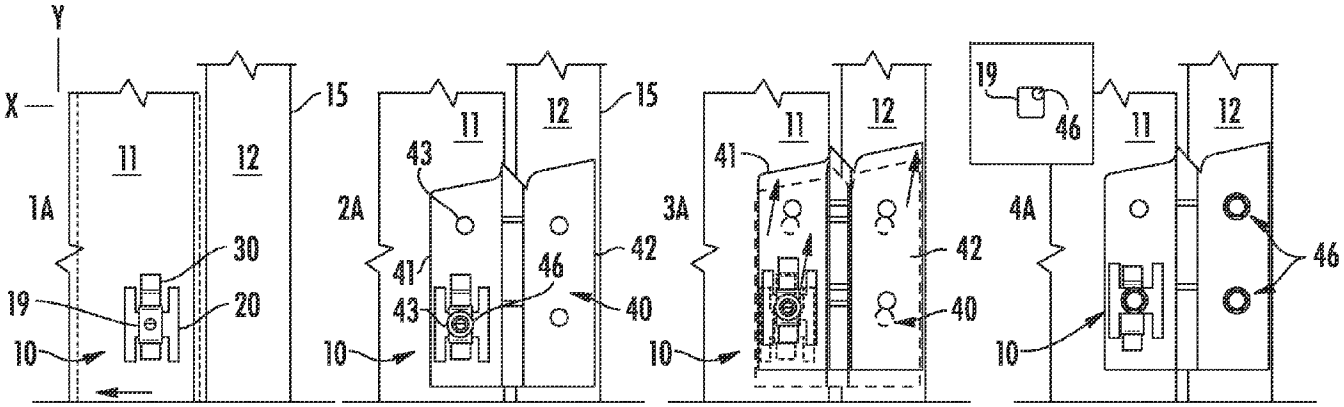
FIG. 17
FIG. 18
FIG. 19
FIG. 20
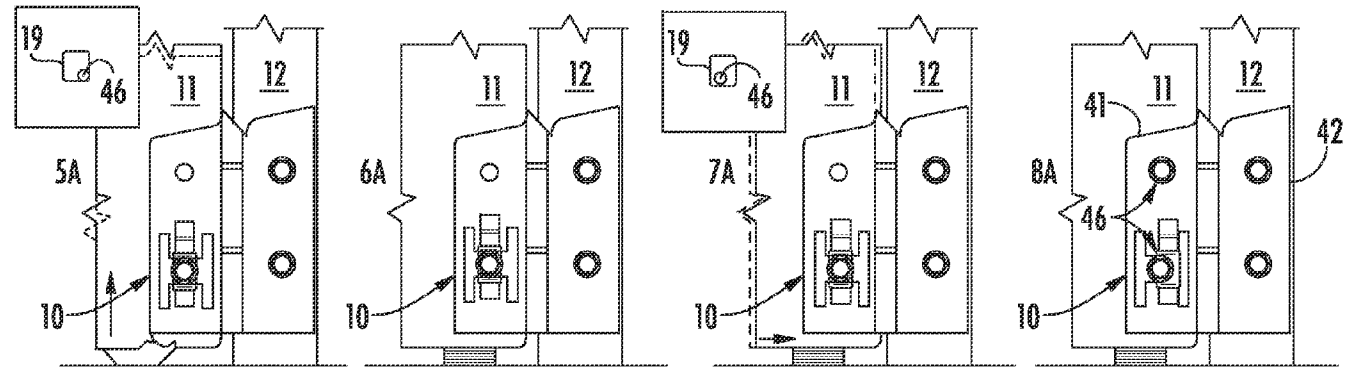
FIG. 21
FIG. 22
FIG. 23
FIG. 24

ADJUSTABLE DOOR MOUNTING SYSTEM

CROSS-REFERENCE TO RELATED APPLICATIONS

This application claims priority to U.S. Provisional Application No. 61/146,507 filed Jan. 22, 2009 and U.S. Provisional Application No. 61/253,957 filed Oct. 22, 2009, the contents of both which are incorporated herein by reference in their entireties.

FIELD OF INVENTION

The present invention relates to door and hinge mounting systems, and more particularly relates to a door mounting system and method providing three-dimensional adjustment of an ingress/egress door in a door frame.

BACKGROUND OF THE INVENTION

More and more, as buildings age, it has become increasingly desirable to replace their doors. However, in the vast majority of cases, the frame is the most difficult component to remove and replace. With wood construction, there is normally a decorative outer casing that hides the juncture between the wall material (e.g., sheetrock or plaster) and the wooden frame. The frame itself is typically shimmed with wedges to achieve a proper position within the roughly assembled underframing. Any door frame stops must also be separated from the frame, unless the stops may have been machined or milled integral to the frame, commonly done with exterior doors for added weatherproofing and security. In most cases the removal and replacement of so many wood components, which may be an important part of the decorative or historic quality of the building, is a serious consideration before contemplating replacement. Metal frames, which are frequently used in commercial buildings, are often anchored to concrete construction, making their removal and replacement very difficult, and involves many operations including demolition and removal, masonry, new frame installation and the repainting of both walls and frames. The fitting of new frames in any type of construction to achieve true and plumb openings, is a task which requires great skill and is extremely costly. Adding to the complexity is the fact that these frames may have originated from a different manufacturer, even in the same building. The minor differences in the actual dimensions of the original doors, even those which have been built to the same nominal size makes the practical replacement of the doors dependent on the actual size of each door as well as the condition of each frame that requires a door replacement. To properly fit a door in this manner requires accurate measurements of frame width and height, as well as other measurements to determine whether the frame is skewed or out of planar flatness and whether the frame corners are square to each other and whether the frame members have remained straight over years of use. Building settling problems and masonry failures add to the difficulty of obtaining a complete dimensional analysis on a frame-by frame basis. The preparation of new, properly fitted replacement doors to these specifications on a door-by-door basis may be cost-prohibitive. Where metal doors, in particular, require replacement, it becomes especially desirable to find a means of utilizing mass-produced doors which feature ease of adjustment to their final operating positions, replicating the original clearances of the openings and their ability to provide or exceed their original performance specifications as well as to restore safety and extended life to the building.

This inventor's longitudinally-extending continuous hinges, such as those for example shown in my U.S. Pat. Nos. 3,092,870; 3,402,422; 4,976,008; 4,996,739; 4,999,878; 4,999,879; 4,999.880; 5,001,810; 5,201,902; 5,778,491; 5,991,975; 6,732,409, and co-pending allowed U.S. patent application Ser. No. 11/628,624 (to be issued as U.S. Pat. No. 7,650,670 on Jan. 26, 2010); the disclosures all of which are incorporated herein by reference in their entireties, and particularly those designed for the simple adjustment of a door in the horizontal and vertical reference plane, allows door replacement with a new door of virtually any material, and accomplished with ease and precision. These continuous hinges extend for substantially the entire height of the door. This procedure is facilitated by using a slightly undersize door. A new, closer fit at the top or header can partially be accommodated by a new threshold, readily obtainable in different thicknesses. Lockside clearances may similarly be adjusted as desired, with any door gap on the opposing hinge side covered by the continuous hinge itself.

While both metal and wood doors are readily mounted and adjusted with these hinges, some other prior hinges have relied on either sliding hinge components or slotted screw holes to allow for simple door positioning. An improved system and method are desired for providing field adjustability when installing doors as particularly applicable without limitation in retrofit or replacement door installations while utilizing an existing door frame.

SUMMARY OF INVENTION

Embodiments of the present invention provide a door and hinge attachment system and method for aligning and mounting a vertically-hung door in a frame that provides three-dimensional adjustability of the door in relation to the frame. This advantageously enables installers to make vertical and horizontal adjustments in the plane of the door relative to the door frame, and further in some embodiments perpendicular to the plane of the door relative to the frame (i.e. inwards or outwards relative to the frame as well as rotationally relative to the horizontal axis of the door or frame, sometimes called a fourth axis).

In preferred embodiments, an adjustable door mounting system according to the present invention includes a user-adjustable door insert or captive nut assembly including a movable adjusting plate and a holding bracket for attachment to a door and/or door frame as further described herein. The adjusting plate includes a fastener hole that is configured and adapted to receive a threaded fastener. The threaded fastener is inserted through a hinge leaf which may be attached to a door and/or door frame. As described herein with reference to various exemplary embodiments and associated door installation methods, this enables an installation to properly adjust and hang a door within new and/or existing and sometimes deteriorated door frames.

In one embodiment, the mounting system includes one or more captive nut assemblies mounted to the door. The captive nut assembly includes a movable adjusting plate ("nut") retained by a stationary holding bracket mounted to the door. In preferred exemplary embodiments, the captive nut assembly is mounted inside a door having a hollow portion configured and dimensioned for accommodating the captive nut therein. In one embodiment, the door may be a metal door. A threaded fastener inserted through a hinge door leaf and into the adjusting plate allows an installer to move and adjust the position of the hinge relative to the door in a first reference plane. In other embodiments, captive nut assemblies may further be affixed to the door frame. A threaded fastener inserted through a hinge frame leaf and into the adjusting plate allows an installer to move and adjust the position of the hinge and door relative to the frame in a second reference plane different than and preferably perpendicular to the first plane in some embodiments.

According to one embodiment, an adjustable door mounting system includes an access door, a hinge including a door leaf and a frame leaf pivotally connected together, and a captive nut including a holding bracket attached to the door and an adjusting plate movably retained within the bracket. The adjusting plate is configured and adapted for receiving a fastener therein inserted through the door leaf. The captive nut is operable to adjust the position of the door in a first reference plane.

According to another embodiment, an adjustable door mounting system includes a door, a door frame attachable to a building superstructure, a hinge including a pair of leaves pivotally connected together for supporting the door, and a captive nut including a holding bracket attached to the door or frame and an adjusting plate movably retained within the bracket. The adjusting plate is configured and adapted for receiving a fastener therein inserted through one of the leaves the hinge. The captive nut is operable for adjusting the position of the door relative to the door frame.

According to another embodiment, an adjustable door mounting system includes a door; a hinge including a door leaf and a frame leaf pivotally connected together, at least one of the leaves including an elongated slot configured for receiving a fastener therethrough, and a captive nut including a holding bracket attached to the door and an adjusting plate movably retained within the bracket. The adjusting plate is configured and adapted for receiving a fastener therein inserted through the door leaf. The captive nut is operable to adjust the position of the door in a first reference plane.

According to another embodiment, a method for aligning and mounting a door in a door frame preferably includes at least the following the steps of: positioning a movable door in a stationary door frame; placing a first leaf of a door hinge against a face of the door; inserting at least one first fastener through a mounting hole in the first leaf; engaging with the first fastener a movable adjusting plate retained in a holding bracket attached to the door; and sliding the hinge along the face of the door with the fastener engaged with the adjusting plate to position the hinge in relation to the door and frame.

According to yet another embodiment, a method for aligning and mounting a door in a door frame includes at least the following steps of: placing a first leaf of a door hinge against a door frame defining a door opening; inserting at least one first fastener through a mounting hole in the first leaf, the fastener defining a pivot point; pivotally moving the hinge around the pivot point to position the hinge in the frame; inserting at least one second fastener through a mounting hole in a second hinge leaf pivotally connected to the first hinge leaf; engaging with the second fastener a movable adjusting plate retained in a holding bracket attached to the door; and sliding the door relative to the second hinge leaf with the second fastener engaged with the adjusting plate to position the door in relation to the hinge and frame.

BRIEF DESCRIPTION OF THE DRAWINGS

The features of the preferred embodiments will be described with reference to the following drawings where like elements are labeled similarly, and in which:

FIG. 5 is a partial exploded perspective view of an exemplary door and longitudinally-extending continuous hinge installation using the captive nut of FIG. 1 in which part of;

FIGS. 17-24 show an exemplary embodiment of sequential method steps for mounting a door and adjusting the door alignment in a first reference X-Y plane using captive nuts as disclosed herein;

DETAILED DESCRIPTION OF THE PREFERRED EMBODIMENTS

Figure 1:
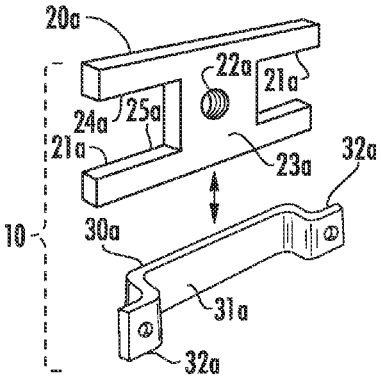
FIG. 1 is an exploded perspective view of a captive nut assembly according to one exemplary embodiment of the present invention showing an adjusting plate and holding bracket.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

In the description of embodiments of the invention disclosed herein, any reference to direction or orientation is merely intended for convenience of description and is not intended in any way to limit the scope of the present invention. Moreover, the features and benefits of the invention are illustrated by reference to preferred embodiments. Accordingly, the invention expressly should not be limited to such preferred embodiments illustrating some possible but non-limiting combination of features that may be provided alone or in other combinations of features; the scope of the invention being defined by the claims appended hereto.

Embodiments of the present invention described herein shows how an adjustable door and hinge mounting system according to the present invention, that comprises one or more simple adjusting plates ("nuts"), which may be threaded in some embodiments, that are slidably attached to the interior sheet metal face of a hollow metal door with preferably small holding brackets (preferably projection welded to the door skin during its construction), can be used to temporarily attach the hinge to the door by essentially clamping the hinge to the door during its adjustment phase of the installation. The holding brackets may be attached to the door or frame by any suitable means conventionally used in the art such as without limitation for example welding or mechanical fasteners. It will be seen that a variety of designs for an internal holding bracket and adjusting plate combinations or assemblies (i.e. also referred to for convenience herein as adjustable "inserts" or preferably "captive nuts"), pre-installed in the door behind an oversize or enlarged door interior access hole or port, can be used to lightly attach the hinge with one or more bolts sufficient to hold the door weight through one or more trial swings of the door to determine its best clearances. By loosening the bolts just enough to re-position the door to optimize those clearances, the door position can be shifted quickly and safely by the installer. No slotted screw openings in the hinge are required thereby. In some embodiments, as further described herein, the "captive nuts" disclosed herein may be held in the same way as their pre-threaded counterparts, but which may be thinner and are prepared without holes or screw threads to receive sheet metal screws, or self-drilling sheet metal screws or self-drilling machine screws FIGS. 1 and 5-7 show an adjustable door mounting system that provides adjustability for mounting the door in the X-Y plane. A non-limiting X-Y-Z reference coordinate system for convenience of use in describing the preferred embodiments is shown for example in FIGS. 5 and 25 relative the door frame opening 29. The Y-axis defines vertical positions and the X-axis and Z-axis defines respectively perpendicular horizontal positions to the Y-axis as shown. The X-Y plane is defined as in the plane of the door frame opening and the X-Z and Y-Z planes are defined perpendicular thereto to the plane of the door frame opening (is. inwards or outwards relative to the frame).

Referring now to FIG. 1, the adjustable door mounting system includes a captive nut 10 assembly including a movable adjusting plate 20*a* and a stationary holding bracket 30*a*. Adjusting plate 20*a* is preferably sized smaller in at least one dimension than holding bracket 30*a* and is movably retained within the bracket allowing the adjusting plate to be moved to a plurality of possible positions in relation to the holding bracket. In this one possible exemplary embodiment, adjusting plate 20*a* may be generally H-shaped and includes two opposing cutouts or recesses 21*a* that open outwards and a fastener hole 22*a* for receiving a conventional threaded fastener therethrough. The fastener hole 22*a* may be plain and unthreaded for receiving a conventional pointed or self-tapping screw or it may be threaded to receive a complementary conventional threaded machine screw. In preferred embodiments fastener hole 22*a* is centrally located on a center portion of plate 20*a* between recesses 21*a*. In other embodiments, as described herein, hole 22*a* may be omitted entirely from adjusting plate 20*a* particularly for use in combination with self-drilling and tapping screws.

Figure 5:
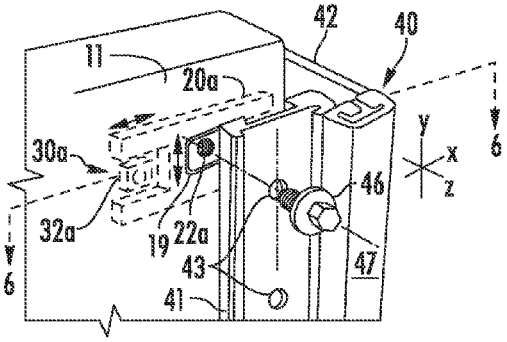
Figure 6:
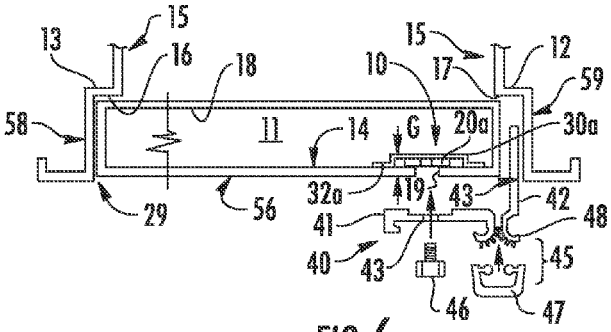
FIG. 6 is a cross-sectional view of the door and hinge installation of FIG. 5.

Referring to FIGS. 1 and 5-7, holding bracket 30*a* may be generally strap-like or U-shaped in structure in some preferred embodiment and includes an offset section 31 and two opposing mounting ends 32*a*. Mounting ends 32*a* may be configured as outward or inwardly turned flanged portions of holding bracket 30*a* in some embodiments to facilitate attachment to a door 11 and/or a door frame 15 attachable in turn to a building superstructure as further shown in FIGS. 8-13 for providing additional adjustability of door 11 into and out of the X-Y plane of the door frame opening 29 along the Z-axis (see FIGS. 5 and 25 for reference coordinate system). In one embodiment, mounting ends 32*a* preferably are generally flat for abutting and mounting to the interior skin or surface 14 of a door as shown as shown in FIG. 6 or to door frame 15. Mounting ends 32*a* may face outwards away from offset section 31*a* in preferred exemplary embodiments to facilitate attaching to metal doors or door frames and to wooden frame. Offset portion 31*a* is thus spaced apart or away from and generally parallel mounting ends 32*a* such that when holding bracket 30*a* is mounted to the interior surface of door 11 as shown in FIG. 6, a space or gap G is created between the interior surface 14 of door 11 and holding bracket 30*a* for movably receiving adjusting plate 20*a* therebetween. Preferably, adjusting plate 20*a* and holding bracket 30*a* are cooperatively configured and dimensioned so that gap G is large enough to allow sliding movement of the plate, but not too large so that excessive play occurs between the interior surface 14 of door 11 and adjusting plate 20*a*. This might cause the plate 20*a* with fastener hole 22*a* therein to become overly angled or titled relative to the door to the point where inserting and threading a threaded fastener 46 into fastener hole 22*a* and proper threaded engagement is impeded if the hole and fastener are axially misaligned. It is well within the ambit of those skilled in the art to determine the necessary gap G required to allow the needed movement of the adjusting plate 20*a* without permitting excessive tilting. Furthermore, in preferred embodiments, adjusting plate 20*a* and holding bracket 30*a* are cooperatively configured and dimensioned so that the adjusting plate cannot twist or rotate excessively relative to the holding bracket and door 11 to ensure that fastener hole 22*a* is accessible through a door interior access opening or port 19 in door 11 as further described herein.

Figure 8:
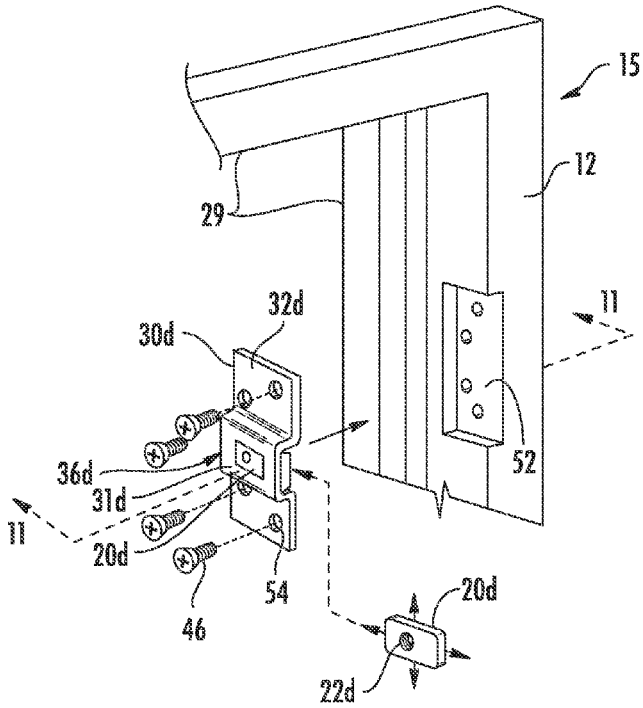
FIG. 8 is a partial exploded perspective view of an exemplary door frame and captive nut installation using another embodiment of a captive nut.

Mounting ends 32 of holding bracket 30 may be attached to metal doors and door frames and/or wooden door frames by any suitable means such as spot or seam welding, mechanical fasteners (e.g. screws, rivets, etc.), suitably strong adhesive or adhesive epoxy compounds, and any other suitable method so long as the holding bracket may be rigidly attached to the door and/or door frame with suitable strength to at least partially support the weight of the door during the installation processes described herein. Mounting ends may be solid or may contain mounting holes 54 as shown in FIG. 8 for receiving mounting fasteners as described in more detail herein. In some embodiments, mounting ends 32 may be turned inwards and for mounting to a metal door and/or door frame (similarly to inward turned flanged holding bracket sections 37*c* shown in FIG. 3) where the attachment method used may be tack or seam welding.

Figure 7:
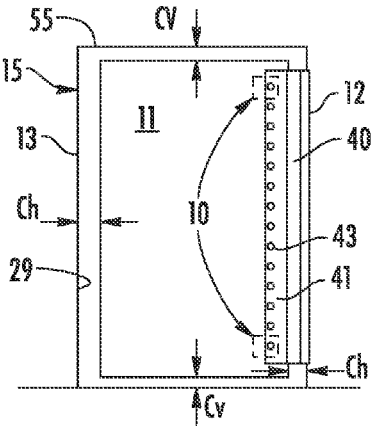
FIG. 7 is full side elevation view of the door and hinge installation of FIG. 5.

FIGS. 5-7 show captive nut 10 mounted to a door 11, which in this embodiment is a hollow metal door defining an internal cavity 18. With reference to FIGS. 1 and 5-7, door 11 may be mounted in a conventional door frame 15 including a vertical lock side frame jamb or section 13 and vertical hinge side frame jamb or section 12 that define a frame opening 29 for receiving the door. Lock side frame section 13 includes a conventional lock side door stop 16 and an inward facing lock side rabbet 58 as best shown in FIG. 6. Hinge side frame section 12 similarly includes a conventional hinge side door stop 12 and an inward facing hinge side rabbet 59 (see FIG. 6). A hinge 40 is provided for pivotally connecting the door 11 to frame 15 allowing the door to be swung open or closed. Hinge 40 may be any suitable type of hinge including without limitation conventional butt hinges, barrel hinges, or longitudinally-extending continuous hinges such as any of those examples of continuous hinges disclosed in this inventor's patents listed in the preceding Background. In this embodiment, one type of longitudinally-extending continuous hinge 40 extending vertically for substantially the height of the door is shown. Hinge 40 defines a longitudinal axis extending along the length of the hinge, which generally may be a vertical axis when the hinge is installed in the door frame 15. Hinge 40 includes a door leaf 41 having a plurality of conventional mounting holes 43 therein and a frame leaf 42 having a plurality of mounting holes 43 therein. A plurality of threaded fasteners 46 which are inserted through holes 43 are provided with the system for attaching hinge 40 to door 11 and frame 15. Mounting holes 43 are therefore preferably round and sized just slightly larger than the shanks of threaded fasteners 46 for passing the shanks through the holes without substantial play between the holes and fastener shanks. Leaves 41 and 42 are pivotally connected together by a joining mechanism 45, which in the embodiment shown may include a vertically-extending clamp 47 that engages longitudinally-extending geared segments 48 formed on a vertical edge of each leaf (best shown in FIG. 6). Examples of such a hinge leave joining mechanism are disclosed in U.S. Pat. Nos. 3,402,422 and 5,991,975 to this same inventor, both of which are incorporated herein by reference in their entireties. Other suitable joining mechanisms (e.g. knuckles and pins, etc.) may be used.

It should be noted that the threaded fastener 46 described herein may include any type of fastener conventionally used in the art for installing doors, hinges, and hardware to door frames. Some exemplary embodiments include without limitation pointed sheet metal screws, self-drilling sheet metal screws, machine screws, and self-drilling machine screws.

With continuing reference to FIGS. 1 and 5-7, holding bracket 30*a* is shown rigidly affixed to interior surface 14 of door 11 in cavity 18 by any suitable means conventionally used in the art such as preferably welding, adhesives, or mechanical fasteners such as without limitation screws, bolts, rivets, etc. Holding bracket 30*a* is oriented horizontally in this embodiment and traps or captures adjusting plate 20*a* in gap G between the bracket and interior surface 14 of door 11. An enlarged door interior access opening or port 19 is formed in door 11 through which fastener hole 22*a* of adjusting plate 20*a* is visible and accessible for threadably mounting hinge leaf 41 to the plate using one of the threaded fasteners 46, as best illustrated in FIG. 5. Access port 19 may be any suitable size and shape such as rectilinear (as shown) including square, rectangular, and elongated slotted shapes with squared off or rounded ends, curvilinear shapes, and others not being limited to any particular shape or configuration. Preferably, access port 19 is enlarged to be larger in at least one dimension (e.g. length and/or width) than fastener hole 22*a* of adjusting plate 20*a* to provide a range and plurality of possible positions and adjustment for the hole and adjusting plate relative to the access port. Accordingly, access port 19 is further preferably enlarged to be larger in at least one dimension (e.g. length and/or width) than the shank of a threaded fastener 46 intended to be inserted through the access port to engage the adjusting plate 20*a* or fastener hole 22*a* in plate 20*a* if provided. Preferably, the access port 19 and adjusting plate 20*a* are cooperatively configured and dimensioned along with the holding bracket 40 such that fastener hole 22*a* remains visible and accessible near the bottom edge of the access port (see, e.g. FIG. 14) when the adjusting plate drops and rests against the holding bracket due to gravity (for non-spring-loaded embodiments of the captive nut 10).

Figure 14:
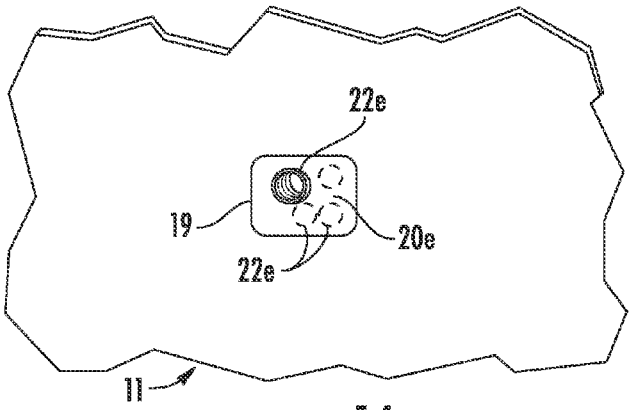
FIG. 14 is a partial front perspective view of a door with access port therein showing a an adjusting plate of captive nut with fastener hole mounted in the interior of the door.

Referring to FIGS. 1 and 5-7, the recesses 21*a* of adjusting plate 20*a* face horizontally outwards towards the right and left and the plate is movable along the X-axis in either of these directions. The extent of horizontal movement and adjustment possible of adjusting plate 20*a* is restricted by the flanged mounting ends 32*a* on either side of holding bracket 30*a* which acts as a horizontal limit stop when the central section 23*a* lying between recesses 21*a* abuts the mounting ends 32*a* of bracket 30*a* see directional movement arrows in FIG. 5). The extent of vertical movement and adjustment possible of adjusting plate 20*a* is similarly restricted by the flanged mounting ends 32 on holding bracket 30*a* which acts as a vertical limit stop when the top or bottom surfaces 24*a*, 25*a* of plate 20*a* defining each recess 21*a* abuts the mounting ends 32*a* of bracket 30*a* (see directional movement arrows in FIG. 5). Preferably, adjusting plate 20*a* and holding bracket 30*a* are cooperatively configured and dimensioned so that a range of horizontal and vertical motion in the X-Y plane is provided to allow the position of the door 11 to be adjusted relative to hinge 40 and door frame 15, as further described herein. As shown in FIG. 14, this advantageously provides a plurality of possible vertical and horizontal mounting positions within the foregoing vertical and horizontal ranges of adjustment because the position of fastener hole 22*e* in adjusting plate 20*e* may be varied in access port 19 to obtain the desired position (illustrated by dashed holes 22*e* in FIG. 14).

Both adjusting plate 20 and holding bracket 30 are preferably made of a suitably strong metal or plastic capable of temporarily holding the door in position while hinge 40 is temporarily secured to the adjusting plate and the door is positioned within door frame opening 29 by an installer. In some exemplary embodiments, adjusting plate 22 and holding bracket 30 may be made of aluminum or steel. However, any suitable metal or plastic may be used. Further, embodiments of an adjusting plate 70 made of a resilient plastic material and configured as in FIG. 46 or similarly with flanges 73 could be cooperatively dimensioned with the holding bracket 30*i* to provide a spring-biased captive nut that functions the same in principle as adjusting plate 120 shown in FIG. 70 to bias the adjusting plate into engagement with door 11.

Referring to FIG. 7, at least preferably one but more preferably two captive nuts 10 are provided with door 11 to allow the door to be temporarily held in position during the door adjustment process within the door frame opening 29. Captive nuts 10 are mounted to door 11 near the hinge side of the door for mounting to hinge 40. Additional captive nuts 10 may be provided along the height of door 11 such as halfway up the door near the middle.

Referring to FIGS. 1 and 5-7, the basic operation of captive nut 10 will now be briefly described with a more detailed description of an exemplary door hanging method to be more fully described in detail later. The overall sequence of installation for captive nut 10 is to first attach the frame leaf 42 of hinge 40 to hinge side frame section 12 of an existing frame 15 by inserting and securing at least two or more threaded fasteners 46 through holes 44 into the frame. A suitable number of fasteners should be used to at least temporarily secure the hinge to the frame and support door 11 when attached thereto in the following steps. It should be noted that the frame 15 may be made or of wood or metal. Next, door leaf 41 is attached to the adjusting plate 20*a* of captive nut 10 provided with door 11 by inserting a threaded fastener 46 through hole 43, through access port 19 in the door, and threadably engaging fastener hole 22*a* of the plate as shown in the figures. Preferably, the fastener 46 is tightened sufficiently to provide just enough tension and support to keep the door 11 in its proper X-Y plane within door frame opening 29 while positioning the door to obtain the desired vertical and horizontal clearances Cv and Ch between the door and door frame 15. When the desired position of door 11 is achieved, fastener 46 may optionally be further tightened snugly to further assist holding the door in position. This draws adjusting plate 20*a* into frictional engagement with interior surface 14 of door 11. In some embodiments, the foregoing steps may completed for each additional captive nut 10 provided. Next, when the foregoing door adjustment and alignment steps are completed, the remaining door leaf fasteners 46 (not shown) are tightly installed through the additional conventional screw holes not positioned adjacent the captive nuts 11 to complete the hinge installation to the door 11. Fasteners 46 such as self-drilling screws would be a desirable fastener for use in those conventional hole locations with either a metal or wood frame 15. Unlike other systems, the hinge 40 in some embodiments could be loosely pre-attached to the door 11 and captive nuts 10 for ease of shipment without compromising its adjustability. This saves the step of having the installer attach the hinge 40 to the captive nuts 10 in the field.

Figure 2:
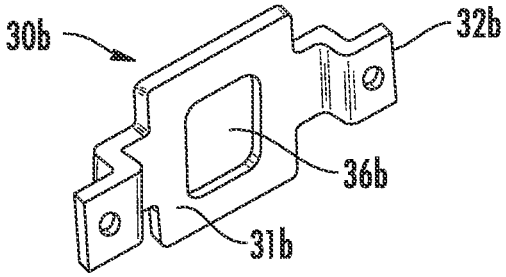
FIG. 2 is a perspective view of another embodiment of a holding bracket useable in the captive nut of FIG. 1.
Figure 15:
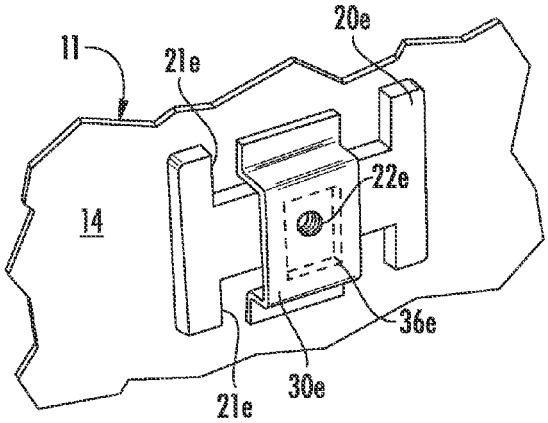
FIG. 15 is a partial rear perspective view of the door and captive nut of FIG. 14.

FIGS. 14-15 shown an additional embodiment and alternative installation position of captive nut 10 wherein the H-shaped adjusting plate 20*e* is installed rotated 90 degrees from that shown in FIGS. 5 and 6 such that recesses 21*e* face vertically upwards and downwards instead of horizontally to the right and left. Holding bracket 30*e* is also rotated 90 degrees and oriented vertically instead of horizontally to accommodate the orientation of adjusting plate 20. As further shown in FIGS. 2 and 15, holding bracket 30 may include an aperture 36 in some embodiments to accommodate longer threaded fasteners 46 having an installed length longer than gap G.

Figure 16:
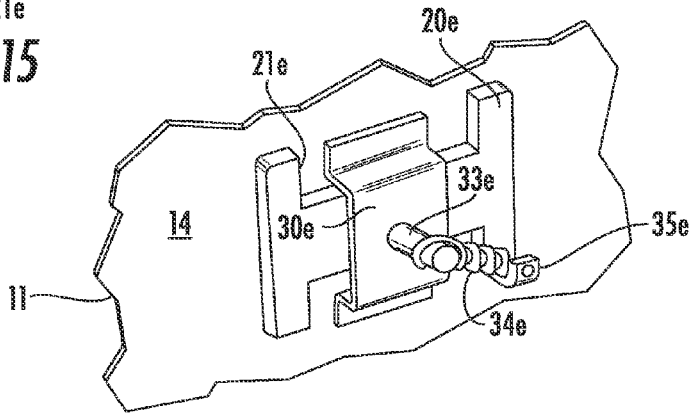
FIG. 16 is a partial rear perspective view of the door of FIG. 14 with a spring-loaded captive nut assembly.

FIG. 16 shows a variation of the captive nut 10 shown in FIGS. 14 and 15 having a spring-loaded centering mechanism including a spring 34*e* which is intended to maintain and/or return fastener hole 22*e* in adjusting plate 20*e* near the center of access port 19 formed in door 11. Advantageously, this holds the fastener hole 22*e* and plate 20*e* in a relatively constant position malting it easy for the installer to locate the hole and thread a fastener 46 therein when attaching hinge 40 to the captive nut 10. In one possible embodiment, as shown, holding bracket 30*e* includes a protruding post 33*e* connected to one end of a spring 34*e* and adjusting plate 20*e* includes an extension arm 35*e* disposed perpendicular to the plate connected to the second end of the spring. In one embodiment, as shown, extension arm 35*e* may be attached to one of the ends of the adjusting plate 20*e*. Spring 34*e* may be any suitable type of spring including without limitation a helical spring as shown. It will be appreciated that other possible embodiments of a spring loaded centering mechanism may be provided based on the embodiment shown in FIG. 16.

In the alternate embodiment as shown in FIG. 16, the spring 34*e* further biases the captive nut 10 in a direction that eliminates the need for manual positioning of the hinge 40 relative to the door 11 while the hinge is first positioned loosely on the door. For example, if the hinge 40 is located on the right side of an out-swinging door 11 as shown in FIG. 6, with the door itself resting on the floor, the door 11 would preferably be positioned so that there is no clearance between its lockside edge and the corresponding lockside door rabbet 58 (i.e. recess in door frame in front of stepped lock side door stop 16 facing inwards towards door opening 29 that receives the edge of door 11 as shown in FIG. 6) formed on vertical lock side frame jamb or section 13 of frame 15. If the captive nut 10 (i.e. adjusting plate 20*e*) is pulled by its spring 34 toward the upper right limit of its travel within its holding bracket 30, the attached hinge 40 will thereby be positioned toward the upper right corner of the opening or access port 19 in door 11. The hinge 40, in its most favorable position in relation to the frame 15 would then be attached without further measurement except for its adjustment in the "Z" axis as might be needed. The captive nuts 10 in the door 11 would allow the door to be raised (moving the adjusting plates 20*e* downward within the captive nut access port 19 although stationary relative to the hinge door leaf 41) until the minimum desired door-to-frame top header clearance is reached, and moved away from the lockside of frame 15 (i.e. lock side frame section 13) until proper lockside operating clearance is provided. The spring-biased captive nut 10 embodiment, because it is built into a door which is also properly "handed" at the factory, eliminates the need for the installer to guess at the proper first position of the hinge 40 relative to the door 11 while he or she is attaching its frame leaf 42 to the frame 15. It will be understood that only one biased captive nut may be needed to accomplish this, although more than one nut so equipped may be desirable.

Figure 3:
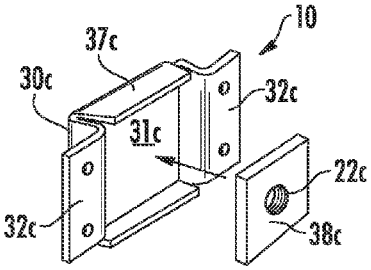
FIG. 3 an exploded perspective view of a another embodiment of captive nut assembly.
Figure 4:
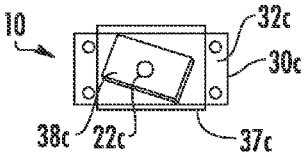
FIG. 4 is a side elevation view thereof.

FIGS. 3 and 4 show an alternative embodiment of a captive nut 10 wherein a adjusting plate 38*c* is provided having a rectilinear shape such as a square or rectangle. Holding bracket 30*c* is configured similarly to the holding bracket shown in FIGS. 1 and 15; however, an inward turned flanged section 37*c* is provided that preferably abuts interior surface 14 of door 11 when installed to retain and trap adjusting plate 38*c* within the holding bracket. Flanged sections 37*c* extend perpendicular to offset section 31*c* of holding bracket 30*c* and further assist in preventing adjusting plate 20*c* from slipping out of holding bracket 30*c* when mounted to a door and/or door frame.

In some embodiments, a further refinement of the door and hinge attachment system could be achieved by stippling of the adjusting plates and/or internal surface of the mating door therewith with raised or depressed dimples, grooves, or other such surface features to increase friction between the adjusting plate and door so that the interface between the internal surface of the door skin and adjusting plates is less prone to slippage when the fastener(s) 46 are tightened after the desired door 11 position is achieved as described above. Clearly, the design of these adjustable inserts or captive nuts 10 could be varied to take advantage of commonly available variations of material, shape and hardness to optimize their performance so long as the adjusting plate 20 or 38 is preferably restrained against excessive rotation relative to holding bracket 30 and door 11.

Figure 13:
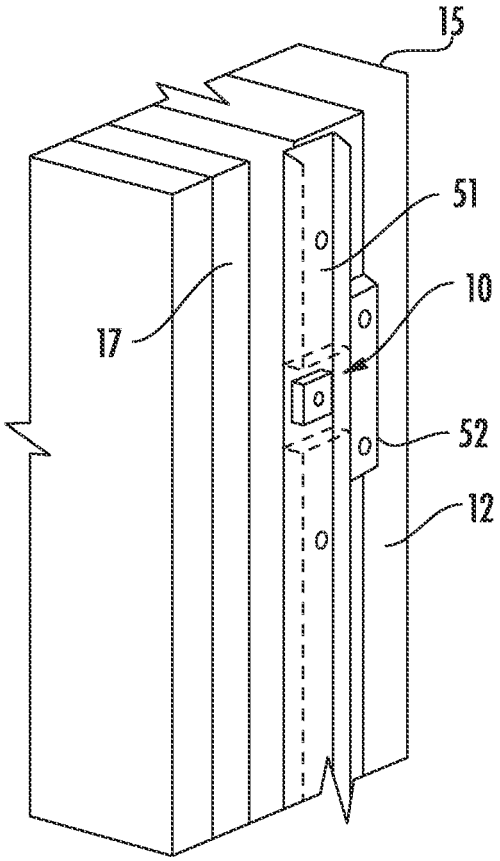
FIG. 13 is a partial perspective view of sheet metal door frame liner attached to the rabbet on the hinge side frame jamb or section incorporating a captive nut.
Figure 11:
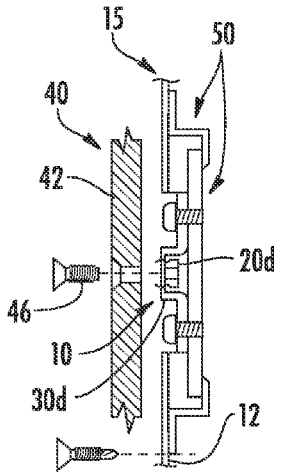
FIG. 11 is a partial cross-sectional view of the door frame and captive nut installation of FIG. 8 as applied to a metal door frame construction.
Figure 9:
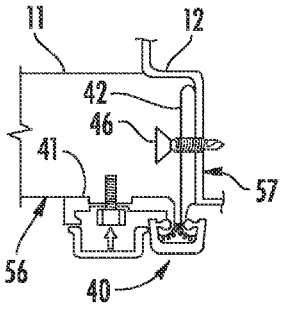
FIG. 9 is a partial cross-sectional view of an exemplary door and half-surface mounted hinge.
Figure 12:
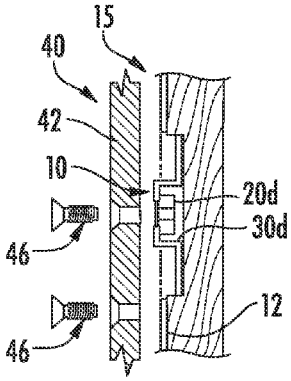
FIG. 12 is a partial cross-sectional view of the door frame and captive nut installation of FIG. 8 as applied to a wooden door frame construction.

In order to achieve adjustability in the "Z" axis (to adjust to misaligned or out-of-plumb frame jambs), it should be understood that a similar fastening method as the foregoing approach could be applied using one or more adjustable inserts (i.e. captive nuts 10) applied to the door frame 15. For example, captive nuts 10 could be mounted to existing, but otherwise unused hinge reinforcing plates 50 commonly prewelded to standard steel door frames for the attachment of butt hinges as shown in FIG. 11. These captive nuts 10 could be supplied pre-installed by the frame manufacturer or installed in the field. Similar captive nuts 10 could be supplied as a part of a specially formed sheet metal door frame "liner" 51 as shown in FIG. 13 that is attached along its edges or screwed to the rabbet on the hinge side frame section 12 of the door frame 15. In other examples, captive nuts 10 could be applied to mortised cutouts in door frame 15 as shown in FIGS. 8 and 1-12. A door 11 sufficiently undersized to accommodate the reduced opening width would be used with a half-surface hinge (as drawn), allowing countersunk screws to be used without the need for unsightly slotted countersunk holes in its leaf. With or without the hinge side frame liner 51, a half-surface hinge 40 such as shown in FIG. 9 is ideal for covering any existing frame cutouts left over from an earlier door installation that utilized butt or mortise hinges, or if the width of the door is made sufficiently undersize, hex-headed screws and washers could even be used and hidden by the door leaf of a half-surface hinge. However, a preferred way to attach the frame leaf 42 of hinge 40 to the rabbet of the vertical door frame hinge side section or jamb is to take advantage of the mortised cutouts formerly used to attach butt hinges by attaching a loosely-fitting adjusting plate 20*d*, very similar in construction to the door version described above in relation to FIGS. 3-4 and further as shown in FIGS. 8 and 11-12.

With continuing reference now to FIGS. 3-4, 8, and 11-12, an adjustable door and hinge mounting system adapted for installing and using captive nut 10 on the door frame 15 will now be further described. This system provides adjustability of the door in the Z-axis as discussed above. As shown in FIG. 8, the adjustable insert or captive nut 10 holding bracket 30*d* would be screwed tight into the old, preexisting threaded hinge holes in the door frame cutouts 52 via outward turned flanged mounting ends 32*d* using appropriate threaded fasteners 46 such as screws inserted through mounting holes 54 formed in mounting ends 32*d*. The holding bracket 30*d* of each captive nut 10 may be secured to either a pre-existing hinge reinforcing plates 50 in a metal frame 15 structure as shown in FIG. 11, or to an existing wooden frame structure as shown in FIG. 12 depending on the type of field installation encountered by the installer. The captive nut 10 is preferably of a compact design as shown in FIG. 3-4 or 8 wherein the adjusting plate 20*c* or 20*d* is mostly enclosed within the holding bracket 30*c* or 30*d* as opposed to a more open captive nut arrangement using the H-shaped adjusting plates 30*a* as shown in FIG. 1 or 15 since the available door frame 15 space for mounting the captive nut is more limited. Preferably, the holding bracket 30*d* of captive nut 10 used for mounting to door frame 15 includes an opening or aperture 36*d* (see, e.g. FIG. 8 or 15) in offset section 31*d* to allow access to fastener hole 22*d* in adjusting plate 20*d* for mounting the hinge frame leaf 42 thereto as shown in FIGS. 8 and 11-12. It will be noted that the position of the captive nut 10 has been essentially reversed for installation on the door frame 15 from that used to mount the captive nut to a door 11 as shown in FIG. 6.

With continuing reference now to FIGS. 8 and 11-12, the newly installed captive nut 10 is used to adjust the "Z" position or door inset of door 111, by attaching the frame leaf 42 of hinge 40 to the frame 15 (i.e. hinge side frame section 12) via the movable adjusting plate 20 held by holding bracket 30*d* secured to the old butt hinge attachment reinforcing plates 50 plates or wooden door frame jamb. One or more screws inserted through a new longitudinally-extending continuous hinge 40 leaf could optionally be used to hold the door 11 in position for adjustment in or out relative to the plane of the wall and door opening 29 in the Z-axis direction, or up and down as well, if it is desirable to add to the vertical adjustment capability of the door-mounted inserts or captive nuts 10.

It will be appreciated that the captive nut 10 assemblies including adjusting plates 20 and holding brackets 30 for mounting to a door or frame are not limited to the embodiments shown herein which illustrate some possible exemplary configurations. Accordingly, the captive nut assemblies may have any suitable configuration so long as the adjusting plate 20 may be movably secured or trapped within the holding bracket 30 and provided with some degree of adjustability in position relative to the bracket and door 11 or frame 15 to which it is attached as described herein.

The use of the adjustable captive nut 10 assemblies described herein for attachment to one or more existing butt hinge mortise cutouts is appropriate for either wood or metal door frames. Of interest is the fact that two of the three axes of adjustment can be achieved with adjustable inserts or captive nuts 10 on either the door or frame (X and Y axes if the captive nuts are used only on the door, or Y and Z axes if used on only the frame). The "frame leaf only" adjustment system is useful with standard frames (wood or metal) if height and inset depth are needed with a full-mortise continuous hinge (fully concealed-leaf model) which, unlike the half-surface models, have both leaves between the door edge and the frame rabbet. These hinges have the advantage of narrow exposed width on the face 56 of the door, as well as lower in-place-cost because they require no moldings to be applied over the door leaf to hide the fasteners.

If the adjustable captive nut 10 assemblies designed for the attachment into the mortise recesses 52 (see, e.g. FIG. 8) of the existing butt hinge cutouts project beyond the face of the original frame rabbet, thin strips of metal or other material can be applied above and below the mortised cutouts as well as in between them. Such shims would be equal to or greater in thickness than the projecting surface of the adjusting plate 20*d* and holding bracket 30*d* assemblies (i-e. captive nuts 10). The hinge attaching screws used to permanently affix the hinge following adjustment in the areas above and below the frame cutouts and their adjustable inserts or captive nuts 10 would be long enough to pass through the hinge thickness plus any shims, and thread into the wood or metal frame base material.

It will be appreciated that the door adjustment system and method described herein may be used with any suitable partial height or longitudinally-extending continuous full height door hinge (see, e.g. FIG. 7). Preferably, the door adjustment system and method may be used with greatest aesthetic benefit with full height type door hinges to conceal possibly uneven and wide gaps that may be present on the hinge side of the door particularly in retrofit door applications in order to provide proper door-frame clearances on opposing lock side of the door for satisfactory latching and locking of the door.

According to additional embodiments of the invention, a method for fully installing the door using captive nuts 10 is provided and will now be described with reference to FIGS. 17-24 showing an exemplary embodiment of a door installation sequence for adjusting the door in the X-Y plane of the door frame opening 29. This exemplary installation method uses an H-shaped captive nut 10 as shown in FIGS. 1 and 14-15 with the captive nut oriented as shown in FIG. 15. It will be appreciated that alternatively the orientation or arrangement of captive nut 10 shown in FIGS. 5-7 may be used or an entirely different non-H-shaped captive nut (see, e.g. FIG. 4) may be used. The method to be described, therefore, is expressly not limited by the design or configuration of the captive nut to be used so long as the adjusting plate 20 is adjustable in position relative to the door 11 to be mounted.

Referring now to FIGS. 6, 15, and 17-24, the method may include Steps 1A-8A as follows.

In Step 1 A, a new door 11 which may be a replacement is first positioned within door frame IS with the door resting on the floor or threshold and pushed laterally left (as viewed in FIG. 17—see directional arrow) over towards the lock side of the door and vertical lock side frame section or jamb 13 as shown in FIG. 17.

In Step 2A as shown in FIG. 18, the hinge 40 is either factory pre-attached, or attached in the field to the door 11 with a single threaded fastener 46 (e.g., machine screw or bolt) inserted through the topmost hole 43 in or hole 43 in proximity to the top of the door leaf 42 of a full-surface hinge 40 (i.e. both door and frame hinge leafs facing outwards as shown in FIG. 18) and into the slidable, bracket-mounted "nut" or adjusting plate 20 through door access port 19 (held to the inner surface 14 of the door skin or face 56 by the preferably spot-welded holding bracket 30*a* shown in FIG. 6 for example). Preferably, another fastener 46 (e.g. machine screw or bolt) is inserted through the corresponding lowermost hole 43 in the hinge door leaf 42 into its corresponding adjusting plate 20 at the bottom corner of the door as shown in FIG. 18. The hinge 40 will, of its own weight, then drop to its lowest position relative to the door when the door is placed within the frame and maintained in an erect position against the frame stops, especially if the hinge is slightly shorter than the door height so that it (the hinge) is not in contact with the floor or threshold when the door is resting on the floor or threshold. This can be noted in FIG. 18 by the position of threaded fastener 46 resting along lower edge of access port 19 in door 11.

The aperture or access port 19 through the skin of door 11 to allow access to the slidable nut or adjusting plate 20 is preferably made large enough to permit vertical movement sufficient to lift the door from its resting position on the threshold or floor to a position of contact with the top frame "header" 55 (see, e.g. FIG. 5) spanning between vertical hinge side frame jamb or section 12 and vertical lock side frame jamb or section 13. For example, if the door is manufactured to a height 112" less than the floor (threshold) to header 55 dimension, then the hinge 40 (with its top and bottom door leaf bolts) will be allowed a similar amount of travel (less a bolt diameter) if the opening that permits access to the nut is ½" high.

MOVE With continuing reference to FIG. 18, with the hinge now so mounted (loosely) to the door 11 via captive nuts 10 described above, and the door resting on the floor (threshold), the door position is checked and is laterally slid to its left if necessary similarly to Step 1A (FIG. 17) until its lockside edge is touching or is in close proximity to the lockside rabbet of the vertical lock side frame section 13 of frame 15. Assuming that the access ports 19 in door 11 allowing access to the top and bottom captive nuts 10 are of essentially a square configuration, the hinge 40 position will be movable laterally in the same manner and amount as its vertical movement range allows.

With the door 11 resting on the floor (threshold) and its lockside edge now in contact with or very close to the lockside rabbet of vertical lock side frame section 13, the hinge 40 will be resting on its fasteners 46 (e.g. bolts) that are lightly secured to captive nuts 10, with the fasteners resting in contact with the lowest edge of their respective door access ports 19 as gravity causes the hinge to drop to its lowest position as shown in FIG. 18.

Next, in Step 3A shown in FIG. 19, the hinge 40 is manually slid or pushed right to a position furthest away from the lockside edge of the door 11 (i.e., towards the frame rabbet of vertical hinge side frame jamb or section 12), while maintaining the stationary position of the door itself. The hinge 40 will then be slid and raised to the highest position that the loosely mounted bolts will allow (with door 11 remaining stationary) as shown by threaded fastener 46 which are now each in the upper right most corner of door access port 19 as shown. This lifts the hinge 40 to a position that enables the door to be subsequently raised to adjust for its "header" 55 (top of the frame) clearance within the confines of the aperture or door frame opening 19 provided for the range of lateral and vertical adjustment of the door. Then, after the foregoing position is reached, both top and bottom threaded fasteners 46 (e.g. screws or bolts) are tightened slightly and sufficiently to retain the position of the hinge 40 relative to the door 1.

Next, in Step 4A shown in FIG. 20 with the door 11 and its hinge 40 thus maintained in position relative to the frame IS completed in Step 3A, the hinge side frame leaf 42 of the hinge is preferably securely fastened to the face of the vertical hinge side frame section 12 complete with all its screws, which may preferably be self-drilling machine screws in some embodiments.

With the hinge frame leaf 42 now secured to frame 15, the top and bottom door leaf threaded fasteners 46 may now be loosened to permit adjustment of the door.

It will be noted that if the captive nuts 10 are equipped with springs 34*e* as noted earlier and illustrated in FIG. 16, the hinge 40 under the biasing effect of the spring will already be lifted and moved away from the lockside edge of the door 11 and upwards to automatically reach the position shown in FIG. 19 (with captive nuts 10 and threaded fasteners 46 in upper right corner of access port 19), thus eliminating the manual pre-positioning of the hinge prior to its attachment to the frame in Step 4A of FIG. 20 as well as eliminating the tightening and re-loosening the door leaf screws prior to door adjustment, because the screws in the captive nuts need only be snug enough to retain the hinge leaf against the door until the door is adjusted.

Three exemplary door leaf installation methods, with variations, may be used and will now be described with reference to FIGS. 21-24 to complete the door and hinge installation process started in Step 1A above.

Door Leaf Installation Method 1: With the top and bottom door leaf 41 fasteners 46 or screws loose, the door can be pried vertically upwards and shimmed as shown in Steps 5A and 6A, FIGS. 21 and 22 respectively, to the desired height (approximately 1/16" to ⅛" from the header of the frame, dependent upon frame condition, rigidity, squareness and other factors judged to be relevant by the installer). Next, in Step 7A of FIG. 23 with the floor (threshold) shims in place (or a counterpart air or hydraulic lifting device which alternatively may be used), the door can be slid and pried to the right away from the vertical lock side frame jamb or section 13 of the frame 15 (typically, with a thin-bladed screwdriver) to provide operating clearance for the vertical lockside edge of the door 11. Perhaps a bit more lateral clearance may be allowed and provided at the top lockside corner of door 11 from door frame lock side section 12 to allow for any door sag which may result when the frame/hinge combination takes the full weight of the door at the conclusion of the installation when all of the supporting shims are removed. After all the clearances are judged to be satisfactory, Step 8A in FIG. 24 is performed in which the top and bottom threaded fasteners 46 attaching door 11 to captive nuts 10 are securely tightened, and all the remaining threaded fasteners 46 in the hinge door leaf 41 are installed through the mounting holes 43 in the leaf and securely tightened to complete the door installation. The shims supporting the door are then removed.

Door Leaf Installation Method 2: With the top and bottom door leaf threaded fasteners 46 loose, the door 11 can be pried vertically and shimmed to the desired height (approximately 1/16" to ⅛" from the header of the frame as shown in Steps 21 and 22 of FIGS. 21 and 22, dependent upon frame condition, rigidity, squareness and other factors judged to be relevant by the installer), as in Method 1. Next, the TOP threaded fastener 46 (only) is tightened to its captive nut 10 behind the door skin. With the floor (threshold) shims still in place, the BOTTOM of the door 11 is pried away from the vertical lock side frame jamb or section 13 of the frame 15 in Step 7A of FIG. 23, and the bottom door leaf 41 hinge threaded fastener 46 is tightened into its captive nut 10. The TOP threaded fastener 46 is then loosened, and the TOP lockside corner is pried away from the frame to provide clearance at the top corner of the lockside of the door. These clearances may be adjusted as above to provide slightly different spacing to allow for frame sag when the weight of the door is taken up by the frame when the floor (threshold) shims are removed. After all the clearances are judged to be satisfactory, the top and bottom threaded fasteners 46 are tightened, and all the remaining screws in the door leaf are applied and securely tightened to complete the door installation as shown in Step 8A of FIG. 24. The shims supporting the door are then removed.

Door Leaf Installation Method 3: With the top and bottom door leaf 41 threaded fasteners 46 loose, the door 11 can be pried vertically and shimmed to the desired height as shown in Steps 5A and 6A of FIGS. 21 and 22, respectively (preferably approximately 1/16" to 1/8" from the header of the frame, dependent upon frame condition, rigidity, squareness and other factors judged to be relevant by the installer), as in Method 1. Next, the TOP threaded fastener 46 (only) may be tightened to its captive nut 10 behind the door skin. A second preferably self-drilling fastener 46 or screw is installed immediately below the topmost threaded fastener 46 secured to captive nut 10, thereby "pinning" the door 11 to the hinge leaf 41 at that location. The floor (threshold) shims are then removed, with the entire weight of the door resting on the two threaded fasteners 46 just described. The bottom of the door is then pried laterally away from the lockside rabbet of the vertical lock side frame jamb or section 13 to its desired lockside clearance as in Step 7A of FIG. 23, and the bottom screw is then tightened securely to captive nut 10. The door will have moved in a "pivoting" action, rotating around a point in proximity to the center between the two topmost threaded fasteners 46. Because the remaining angular adjustment is so slight, the two (or more) closely space threaded fasteners 46 will produce little resistance against the modest prying force needed to achieve optimum lockside clearance. When the clearances are satisfactory, the bottom screw may be tightened into its "nut," and the remaining self-drilling screws installed through the door leaf 41 into the door skin as in Step 8A of FIG. 24 to complete the installation.

The advantage of Door Leaf Installation Method 3 is that the weight of the door is taken up by the frame earlier in the installation, so that frame sag and hinge "play" may be accurately assessed and compensated before installing the remaining leaf threaded fasteners 46 or screws. It should be noted that the sequence of Method 3 may be reversed (top vs. bottom screws tightened first), with the net effect (early assumption of door weight transferred to the frame) remaining relatively the same.

It should also be noted that Door Leaf Installation Method 1 (retaining the floor/threshold shims in position) may be preferable for very heavy doors, such as heavy gauge security doors.

While door adjustments can be made after the frame leaf is firmly attached to the frame, the frame leaf is positioned and fastened to the frame preferably after the door/hinge combination is in an erected position so as to limit the magnitude of the adjustment dimensions required, thereby limiting the access port 19 size for movable adjusting plates 20 and their total range of motion. The foregoing method(s) described herein for mounting and adjusting a door are readily adaptable to building and sizing new replacement doors with widely varying, non-uniform clearances relative to the older frames in which they may be installed. Another advantage is that the hinges used with this invention do not require slots or any special preparation other than a single dimension between round holes in the door leaf that is made to match the center-to-center-dimension between the apertures and "nuts" in the door. Readily available standard hinges can be so prepared on site if needed.

It should also be noted that the same installation methods can be used with one, two or three (or more) captive nuts 10 and access ports 19 in the door 11 without substantial variation from the designs and methods shown.

Figure 10:
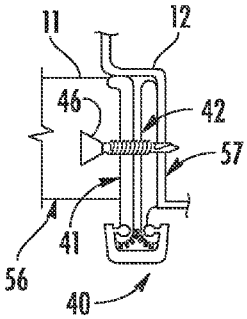
FIG. 10 is a partial cross-sectional view of an exemplary door and full-surface mounted hinge.

One type of hinge anticipated for use with the X-Y door adjustment (i.e., generally horizontally and vertically within the plane of the door and frame opening) could be a simple full-surface hinge (see, e.g. FIG. 18), with leaves attached to the face 56 of the door 11 and to the face or rabbet 57 of the frame 15. In other embodiments, the hinge may be a half-surface hinge as shown in FIG. 9 as well (i.e. with the frame leaf attached to the rabbet or inner surface of the hinge side of the frame instead of to its face). The door installation methods described herein may further be adapted for use in installing fully concealed hinges as shown in FIG. 10.

In some door retrofit or new door installation, it would be useful to be able to adjust the top and bottom corners of the lockside of a door so that they seat against the stop of the door simultaneously when the door is closed. Generally speaking, wood doors will often adjust themselves over time, helped by humidity and the pressure of a door latch which can keep the lockside edge of the door pressed against the frame "stop."

Not so with a steel door. Their limited flexibility will generally cause them to first hit either the top or bottom corner upon closure. Assuming that the door had not been abused, this condition is most frequently caused when frames are not set accurately in the plane of the wall. This can easily happen with poured concrete, and especially in concrete block walls. Steel frames are "slushed" into place with masonry, and most often their vertical legs can be set out-of-line either because the walls themselves are not exactly plumb on each side of the opening, because the jamb size does not exactly match the wall thickness allowing angular "play" before they are fixed in position, or because of frame shipping, handling or storage damage. There is little accuracy in the entire process of setting these frames, because the economics of construction coupled with the lack of special tools or gauging equipment at the job site does little to preclude irregular installation.

There is an obvious need for steel door replacement due to rust and wear, but the difficulty of making these replacements is compounded because the various manufacturers of steel doors sometimes place their hinges and locksets at slightly different heights to make sure that the door and frame is installed as a "package" from a single source. This simplifies the initial installation, but replacement of a door into another manufacturers frame can be extremely difficult. In such situations, a system and method is provided that has the ability to compensate for vertical frame misalignment in the Z-axis as well by providing the ability for adjusting the plane of the door in the X and Y axes directions.

FIGS. 25-34 show an exemplary sequential series of door installation steps that provides for adjustment of a door along the Z-axis (i.e. generally perpendicular to the frame 'L 5 door cutout opening 29 and X-Y plane). In this method, the adjustable frame inserts or captive nuts 10 similar to those shown in FIGS. 4, 8 and/or 11-12 as described herein may be used. The X-Y-Z coordinate system as referenced throughout this disclosure is further shown in FIG. 25.

Figure 25:
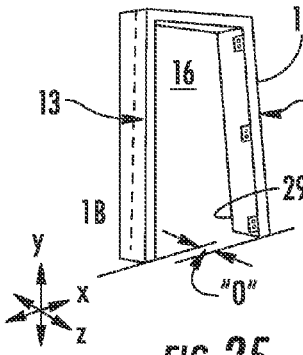
FIGS. 25-34 show an exemplary embodiment of sequential method steps for mounting a door and adjusting the door alignment in a second reference Y-Z plane using captive nuts as disclosed herein.

With reference to the numbered Steps 1B-8B shown in FIGS. 25-34, the door installation and adjustment method preferably includes the following sequential steps shown from initially encountering a misaligned door frame in the field to correcting the problem using the captive nut adjustment system and methods described herein as follows:

Step 1B. This FIG. 25 shows a frequently encountered door 11 installation problem. In some cases the door's frame 15 is installed in a "splayed" condition, where the frame sides may be plumb when viewed in frontal elevation (along the Z-axis), but they are not in the same plane when viewed along the plane of the door opening in the frame (along the X-Y plane). This is illustrated by the frame offset "0" shown in Step 1B of FIG. 25. This makes a door difficult to operate, because its back face does not close against the frame lockside door stop 16 (i.e. vertically-extending frame protrusion as shown in FIG. 1) properly from top to bottom. It should be noted that if the vertical frame members are not plumb in elevation (i.e., wider or narrower at the top than they are at the floor), the system and method described herein addresses correction of not only height and clearances, but also allows for adjustment of edge clearance at the lockside edge of the door relative to the lockside rabbet.

Figure 26:
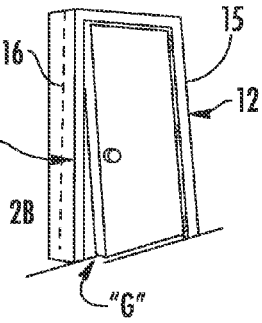

Step 2B. This FIG. 26 shows a door 11 installed in the out of plumb or offset door frame 15 shown at Step 1B in FIG. 25 and described above. Because the door is hinged from one side, all of the planar misalignment will be transferred to the lockside edge. The door will not make full contact against the frame lockside door "stop" 16 (see also FIG. 6) from top to bottom on the lockside evenly (see gap "G" at bottom of door), malting it difficult to seal against light, heat, air and moisture. In addition, the door's uneven impacts against the frame lockside door stop 16 when being closed repeatedly is a major cause of hinge failure. Note that while this illustration in FIG. 26 shows initial contact of the door upon closure at the top corner against the lockside door stop, the condition could be reversed, with initial contact at the frame bottom lockside corner. Either way, this causes unbalanced forces and excess stress on the door 11, the hinge system and the latching device, which may lead to eventual and premature fatigue failure of not only the hardware (the door hinge, closer and lockset) but the door itself. The vibration and "racking" (twisting) action of the door can break the internal spot welds and other connections of the door structure itself.

Figure 27:
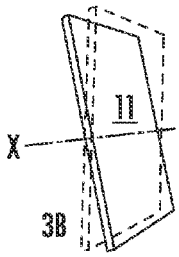

Step 3B. Referring to FIG. 27, if the door 11 (particularly a replacement door, but not limited thereto) could be reinstalled or replaced with an adjustment capability to pivot the door in the direction of the Z-axis along an essentially horizontal or X pivotal axis as shown within or adjacent to the plane of the door, the problems described in Step 2B above could be reduced or eliminated. Accordingly, the present adjustable door and hinge system and method advantageously provides this adjustment capability as to now further be described in the following steps.

Figure 28:
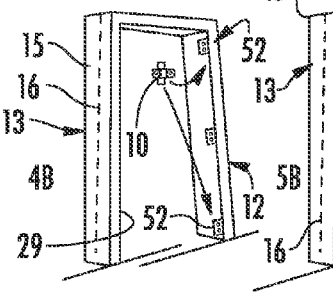

Step 4B. Referring to FIG. 28, using an adjustable frame insert assembly or captive nut 11 such as those shown in FIGS. 4 or FIGS. 8 and 11-12, or similar, the door frame 15 could be prepared for adjustment in the Z-axis direction as referenced in Step 3B of FIG. 27 above using a conventional longitudinally-extending continuous vertical hinge 40 as shown for example in FIGS. 29-34 (i.e. extending along substantially the entire height of the door 11) and described elsewhere herein. This technique preferably requires only that the hinge 40 has fastener (e.g. screw or bolt) receiving mounting holes (see, e.g. FIGS. 5, 7, and 29) prepared to more-or-less correspond to the location and vertical spacing of the captive nuts 10 to be installed according to principles of the invention, which in one embodiment could be conveniently secured to the butt hinge mortised cutouts 52 in the frame 15 (metal or wood) as shown for use with fasteners 46 such as fastening screws (or in some embodiments, the pre-threaded metal hinge plates with threaded bolt-receiving holes welded into the frames as shown in FIG. 11) at the top and bottom which previously were the former location of the conventional butt hinges generally supplied in a frame with the old door. Accordingly, the method for accomplishing this includes first removing all of the existing butt hinges (or pre-existing longitudinally-extending continuous hinge if alternatively encountered) and then installing/attaching captive nuts 10 as shown in FIG. 28 to the frame 15 in preferably at least the top or bottom, but more preferably the top and bottom butt hinge cutouts 52 in the hinge side frame section 12 of the door frame 15 if present as shown.

Figure 29:
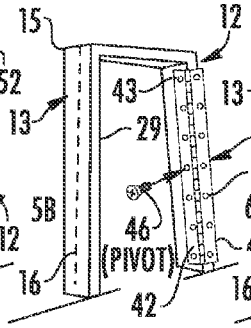

Step 5B. Referring to FIG. 29, in a modification of the first step of hinge installation (following similar methods shown for the general alignment and adjustable vertical and horizontal positioning of a door as already described herein), the hinge 40 may now be pivotally attached to the frame with a fastener 46 such as a single self-drilling and tapping screw as shown, placed preferably, but not necessarily centrally near the mid-height of the hinge. The fastener 46 defines a pivot point for hinge 40 allowing pivotal adjustment along the Z-axis in the Y-Z plane. In the embodiment shown in FIG. 29, the hinge 40 may be longitudinally-extending continuous hinges with a vertical extent or length substantially matching the height of the door opening in the frame. Alternatively in lieu of the screw in some installations, a fastener 46 in the form of a standard hinge bolt of the same size as might have formerly held the center hinge in place could be used, re-engaging the original pre-threaded center metal hinge plate (further described herein) welded into the frames (see, e.g. FIG. 11) when they were new. This center hinge plate embodiment and/or mortised cutout embodiment (depending on the type of installation encountered) are shown in FIG. 28. The centrally-located hinge screw or bolt defines a pivot for the hinge, allowing it to rotate around the X-axis defined by the screw bolt.

Figure 30:
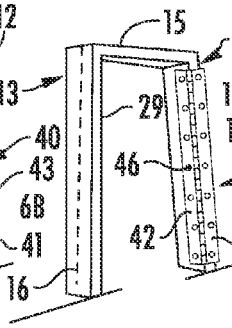

Step 6B. In this step, the position of the hinge 40 can be adjusted relative to the frame 15 to obtain an estimated best hinge position before permanently affixing the hinge to the frame at all points and prior to attaching the door 11 to the hinge. FIG. 30 shows the hinge 40 pivotably mounted to the frame by a single fastener 46 (bolt or screw preferably) attached in Step 5B above which defines a pivot point at or near the hinge's center or mid-height thereby allowing the top and bottom of the hinge to be pivoted back or forth in the direction of the Z-axis (see directional arrows). Obviously, depending upon the severity of the frame misalignment and whether the hinge 40 needs to be angled outward or inward relative to the frame IS, the location of this fastener 46 that defines the hinge pivot point could be modified, favoring either the top or bottom. However, the hinge 40 will be pinned to the frame 15 (specifically frame hinge side section 12) by this pivot point fastener 46, establishing the hinge height relative to the frame and door frame opening 29. In a preferred exemplary embodiment, Step 6B includes inserting threaded fasteners 46 through mounting holes 43 in hinge frame leaf 42 and into captive nuts 10 previously installed which provides a limited range of Z-axis adjustability for hinge 40. In other embodiments, the installer can wait until later in the door hanging steps to insert fasteners 46 into the captive nuts 10 in order to make fine tuning adjustments.

Figure 31:
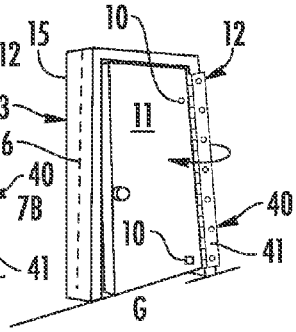

With continuing reference to FIG. 30 and installation Step 6B, to determine the proper position for mounting the hinge 40 to the frame 15, the door 11 itself (provided that it is in a new or relatively flat condition) may be used as a reference plane to preliminarily set the correct angle of hinge relative to the frame face (see also Step 7B in FIG. 31 showing the door pressed against hinge). By pressing the door firmly against the barrel of the hinge 40 from top to bottom, the alignment of the door's lockside edge with the lockside frame face of the vertical jamb or lockside frame section 13 (i.e. vertical portion of the frame) can be readily ascertained by visually estimating or measuring the horizontal distance along the Z-axis from the lockside frame stop 16 (see, e.g. FIG. 6) to a vertical edge of the door facing the frame stop (i.e. gap "G" as shown) at several places along the door height, or similar pairs of reference points that compare the position of the top of the door with the bottom at the lockside. The hinge 40 can then be adjusted (pivoted) around its central or mid-height pivot attachment at pivoting point fastener 46 (screw or bolt), until a satisfactory compromise in distance or gap G is achieved for the door at the lockside, and also preferably the gap on the hingeside as well.

Preferably, then after an estimated proper position of the hinge 40 has been determined and then removing the door 11 from contact with the hinge 40 which is temporarily held in place relative to the frame 15 by any suitable means, the top and bottom ends of the hinge can then be temporarily attached to the frame, either into captive nut 10 assemblies alone installed in Step 4B above if not already done so to allow for additional fine tuning adjustments to be subsequently made, or with some additional self tapping screws fastened through the frame hinge leaf 42 to the frame at other locations such as through holes 43 in hinge 40. Preferably, only enough screws should be used to temporarily support the weight of the door 11 when attached to the hinge 40 in the subsequent steps below for a trial swing to check the Z-axis planar angle of the door in relation to frame 15 to find the best compromise setting or position.

Step 7B. Referring to FIG. 31, after the hinge 40 is temporarily tightened into position on the frame 15 in Step 6B above, the door 11 can be placed between the lockside and hingeside vertical frame jambs or sections 13 and 12 respectively, then the door leaf 41 of the hinge swung horizontally into place against the door (see directional arrow), and then the door leaf attached to the door using threaded fasteners 46 and the captive nuts 10 preferably pre-installed in the face 56 of door 11 and accessible through access port 19 (such as those captive nuts 10 shown for example in FIG. 1, 3, or 15. The captive nuts 10 may only be provided at the top and bottom positions of the door 11 in some embodiments as shown in FIG. 7 for adjustably securing the door to the hinge. However, it will be appreciated that any number and positions of captive nuts 10 may be provided with the door 11.

Figure 32:
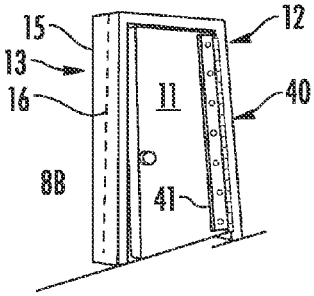

Step 8B. Referring to FIG. 32, the door is shown resting on the floor just prior to making the horizontal and vertical adjustments along the X-axis and Y-axis (i.e. in the X-Y plane) respectively made possible by the movable captive nuts 10 using the same procedures and method already described herein with respect to FIGS. 21-24 and Steps 5A-8A. The door 11 is then adjusted in X and Y position to achieve the proper horizontal lockside door-to-frame clearance Ch (see, e.g. FIG. 7) needed to lock/latch the door and proper vertical top door-to-frame and bottom frame-to-sill clearances Cv (see, e.g. FIG. 7). Additional fasteners 46 are then installed through the door leaf 41 (using pre-existing holes if provided as shown in the drawing figures) at positions other than the top/bottom captive nuts 10 to permanently secure the door leaf of the hinge 40 to the door and fix the position of the door relative to the hinge and frame 15.

If necessary, final adjustments can also then be made as necessary to the alignment of the plane of the door relative to both vertical frame jambs (i.e. in the Z-axis direction) by loosening and retightening the hinge frame leaf 42 screws 46 of the hinge 40 previously installed in Step 6B above (FIG. 30). Once the installer is satisfied with the position of the door 11 relative to the frame 15, any additional fasteners 46 that may be needed to permanently support the weight of the door are installed through the hinge frame leaf 42 into the frame 15 at other vertical positions thereby completing the door installation.

Figure 33:
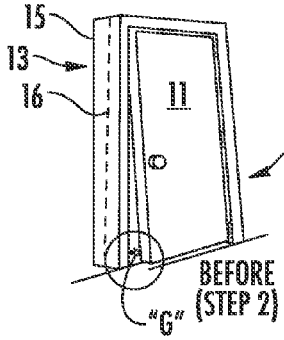
Figure 34:
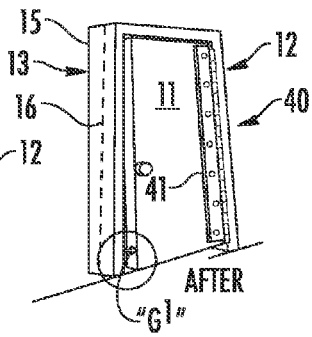

FIGS. 33 and 34 shows a visually exaggerated for convenience comparison, but much improved compromise position of the hinge 40 and door 11 after the foregoing door installation and adjustment Steps 1B-8B are followed providing adjustment in the Z-axis direction to reduce the initially larger gap G identified in Step 2B. The resultant new gap G' is smaller than the initial gap G providing not only an aesthetically better installation, but a more secure and air-tight installation. Some of the angular difference can be left at each jamb (as shown), or all of it can be instead taken on the hinge side and concealed by the longitudinally-extending continuous hinge so that the closing edge of the door on the lockside seals properly.

Figure 36:
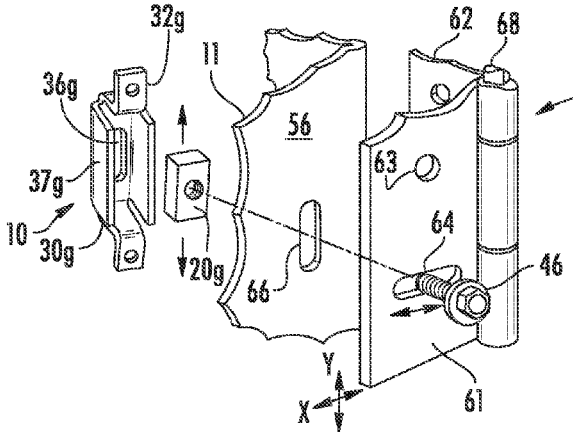
FIG. 36 is a partial exploded perspective view of an exemplary alternate door, hinge, and captive nut installation using another embodiment of a captive nut restricted to single axis motion and including an elongated slot-shaped door interior access port and slotted hinge leaf fastener holes cooperating with the access port.
Figure 37:
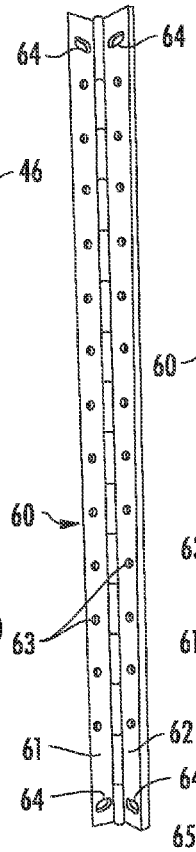
FIG. 37 is a full side perspective view of a longitudinally-extending continuous hinge incorporating the slotted fastener hole arrangement of FIG. 36.

In other possible embodiments of a door installation system according to the present invention, a modification of these foregoing door installation and adjustment Steps 1B-8B described herein providing adjustment of the door along the Z-axis would utilize elongated horizontal slots in the top and bottom ends of the frame leaf of the hinge. Such horizontal slots and vertical slots in hinge leaves of a longitudinally-extending continuous hinge are disclosed in this inventor's co-pending allowed U.S. patent application Ser. No. 11/628,624 (to be issued as U.S. Pat. No. 7,650,670 on Jan. 26, 2020); which is hereby incorporated herein by reference in its entirety. This arrangement would be advantageous if the hinge were to be attached to a frame which could not accept the captive nut assembly, or if those captive nut assemblies were not readily available. One embodiment of such a hinge 40 is shown in FIGS. 36 and 37, which is shown without limitation as a longitudinally-extending continuous barrel and pin hinge 60 including a door leaf 61 and a frame leaf 62 each having a plurality of mounting holes 63 for receiving threaded fasteners 46 therethrough to mount the hinge to a door frame 15 and a door 11 (see, e.g. FIGS. 5-7). Leaves 61 and 62 are pivotally connected together for movement by pin 68 in a conventional manner. Frame leaf 62 preferably includes at least one elongated horizontal slot 64, and more preferably at least two slots 64 with a slot disposed near of the upper and lower ends of the hinge 60 as shown. In some embodiments, both fi-me leaf 62 and door leaf 61 may include one or more elongated slots 64. The slots 64 are cooperatively configured and sized with threaded fasteners 46 to permit only one dimensional adjustment in the X-axis in this embodiment as shown in FIGS. 36 and 37. In some possible embodiments, as shown, both door leaf 61 and frame leaf 62 includes such horizontal slots 64. The procedure for installing door 11 and making adjustments in the Z-axis direction would remain essentially same as in Steps 1B-8B shown in FIGS. 25-34 with installing captive nuts 10 in Step 4B omitted. A steel door 11 as described herein having captive nuts 10 for adjusting its horizontal and vertical X-Y position is provided and adjusted as described in Steps 1A-8A in FIGS. 17-24. In Step 5B (FIG. 29), a temporary threaded fastener 46 is placed first through preferably a mounting hole 63 near the center of hinge 60 which would allow for door plane adjustment along the Z-axis by creating a pivot point, with either a single horizontal slot 64 located near the opposing end of the hinge, or slots 64 preferably provided near both ends of hinge 60 as shown if the pivoting threaded fastener 46 is placed nearer the center. The position of door 11 may then be adjusted as shown in Step 7B of FIG. 31 without the use of captive nuts 10 and instead using horizontal slots 64. The remaining Step 8B is then completed as before. Clearly, because the hinge would not normally not require more that +/−¼ inch vertical adjustment (approximately equal to 10 minutes of one degree in a seven foot high door frame opening), the use of several threaded fasteners 46 in close proximity to the pivot point would not interfere with its angular adjustment.

Another modification of similar nature would utilize horizontal slots 64 in the ends of the door leaf 61 of the hinge 60 as shown in FIGS. 36 and 37. These would permit a captive nut 10 mounted in the door 11 face 56 or skin to be constricted in its motion to the vertical Y-axis direction only by providing a cooperating elongated door interior access ports such as vertical slot or slots 66 in door 11 sized to only permit vertical motion of the threaded fasteners 46 in the slot. That way, the threaded fasteners 46 that are inserted into the captive nuts 10 in the door face 56 would allow the fasteners to be moved within the horizontal hinge leaf slots 64 for horizontal positioning adjustments, and within the door slots 66 for vertical adjustments.

Figure 35:
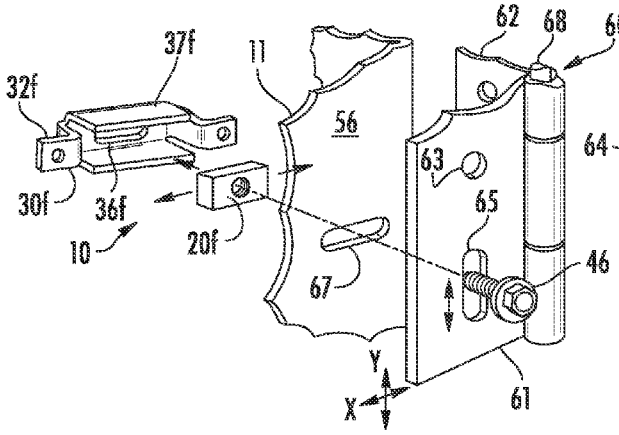
FIG. 35 is a partial exploded perspective view of an exemplary door, hinge, and captive nut installation using another embodiment of a captive nut restricted to single axis motion and including an elongated slot-shaped door interior access port and slotted hinge leaf fastener holes cooperating with the access port.
Figure 38:
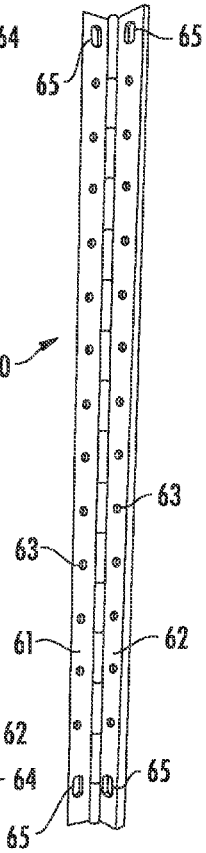
FIG. 38 is a full side perspective view of a longitudinally-extending continuous hinge incorporating the slotted fastener hole arrangement of FIG. 35.

In yet another variation, as shown in FIGS. 35 and 38, the foregoing situation or arrangement would be reversed as shown, i.e., the captive nuts 10 in the door 11 would be allowed to move horizontally only in horizontally elongated door interior access port such as horizontal door slot 67 while using vertical slots 65 in the door leaf 61 of hinge 60 to provide for vertical door positioning.

It will be understood that various combinations of vertical and horizontal motions and restraints of the captive nuts as previously described above coupled with optional various combinations of slotted threaded fastener openings in the hinge could be arranged in multiple locations, all designed to permit the common goal of a clamping action sufficient to hold the weight of the door in a desired position for at least the duration of a trial swing, and to be later supplemented by additional self-threading and drilling fasteners to provide a more permanent fixation. Horizontal slots 64 and vertical slots 65 are cooperatively configured and sized with threaded fasteners 46 to permit only one dimensional adjustment in either of the X-axis, Y-axis, or Z-axis directions as shown in FIGS. 35-38 depending on the combination of slots used in the hinge leaves and/or door.

The hinge 60 could be a barrel and pin piano type hinge of conventional design as described herein, or a preferred hinge designed specifically for architectural use such a half-surface hinge (see, e.g. FIG. 9) configured for attachment to the rabbet 57 of a door frame (i.e. inward facing towards door opening 29 forward of hinge side door stop 17) and to the face 56 of a door 11 (i.e. outward facing away from the door opening). While it would be helpful if the hinge mounting holes 63 were prepared for and corresponded with the spacing of the captive nuts 10 in the door 11, because these holes could be simple, circular screw holes (if the captive nuts were not constrained to movement in a single axis), and because the captive nuts could allow for a large adjustment, hinge holes 63 could easily be added at the job site.

FIGS. 39-45 show additional exemplary embodiments of an adjustable door mounting system using captive nuts 10 in combination with vertical and horizontal slots disposed in door 15 and/or hinge 60. In these embodiments, the captive nuts 10 are restricted to motion in the vertical direction in door 15, which when combined with fasteners 46 applied through horizontal slots in hinge door leaf 61 allow motion in X and Y directions without providing vertical slots in the hinge door leaf.

Figure 39:
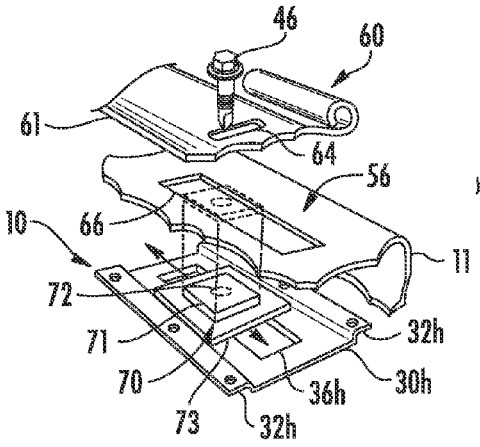
FIG. 39 is a partial exploded perspective view of an exemplary door, hinge and captive nut installation using another embodiment of a captive nut restricted to single axis motion and including an elongated slot-shaped door interior access port and slotted hinge leaf fastener holes cooperating with the access port.
Figure 40:
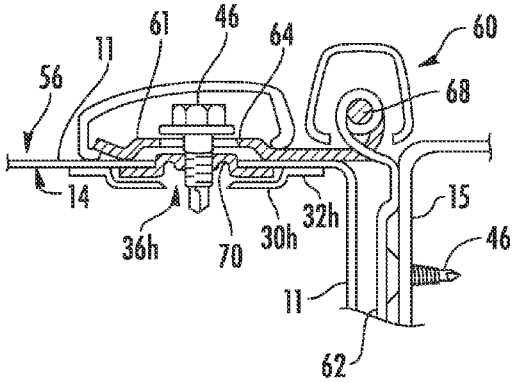
FIG. 40 is partial cross-sectional view thereof as installed on a door.

Referring to FIGS. 39 and 40, the captive nuts 10 include adjusting plates 70 slidably disposed in and supported by holding bracket **30*h*. Adjusting plates 70 have a raised flat portion 71 offset from the main body of the plate which forms flanges 73 disposed on one or more sides of the raised portion as shown to prevent the adjusting plates 70 from falling through access ports 19 in door 11. In some embodiments, the offset raised portions 71 may have cavities formed below if made by metal stamping, extrusion, or other methods (see, e.g. FIGS. 39 and 40) or may be raised solid portions of adjusting plate 70 (see, e.g. FIGS. 43 and 44). Hole 72 is disposed in raised portion 71 and receives a threaded fastener 46 therethrough in the same manner as described herein. Raised portion 71 is configured and adapted to cooperate with elongated vertical slot 66 disposed in face 56 of door 11 to provide guided movement of the adjusting plate 70 within the slot. Accordingly, when captive nut 10 is attached to interior surface 14 of door 11 with holding bracket 30*h* as shown in FIG. 40 in the same manner as already described herein, raised portion 71 of adjusting plate 70 preferably projects at least partially into vertical slot 66 in door 11 to slidably contact the door, and more preferably may project through and slightly above slot 66 as shown. In contrast to the captive nuts 10 shown in FIGS. 35 and 36 wherein adjusting plates 20*f* and 20*g* having uniformly flat surfaces, the adjusting plate 70 movement as shown in FIGS. 39 and 40 are guided by the raised portion-slot interaction and further guided by outward turned flanged mounting ends 32*h* on holding bracket 30*h* as shown which cooperate with the side edges of adjusting plate 70. The projection of raised portion 71 into slot 66 of door 1 also advantageously helps slidably and movably retain the adjusting plate 70 in holding bracket 30*h* when assembled to the door as shown in FIG. 40 thereby the need for providing supplemental retaining means in either the bracket (see, e.g. FIG. 3, 36, or 46 in which holding bracket 30*c*, 30*g*, or 30*j* includes inward turned portions 37*c*, 37*g*, or 37*j***) or other in the door itself.

Figure 41:
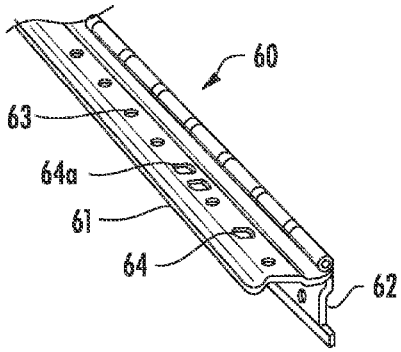
FIG. 41 is a partial perspective view of a longitudinally-extending continuous hinge including a plurality of slotted fastener holes.

With continuing reference to FIGS. 39 and 40, door leaf 61 of hinge 60 includes one or more horizontal slots 64 as shown in FIG. 41 in a manner similar to that shown in FIG. 37. The horizontal slots 64 combined with vertical slots 66 in door 11 provide mounting adjustability for the door relative to frame 15 in both the X-axis and Y-axis directions. Holding bracket **30*h* may include an elongated aperture 36*h* as already described herein to allow the shank of a long threaded fastener 46 to protrude therethrough as shown in FIG. 40. Preferably, the aperture 36*h* has a length substantially coextensive with the length of elongated vertical slot 66 in door face 56 so that the shank of threaded fastener 46 may pass through the aperture for the full range of vertical motion provided by slot 66 to adjusting plate 70 (see directional arrows, FIG. 39**).

Figure 42:
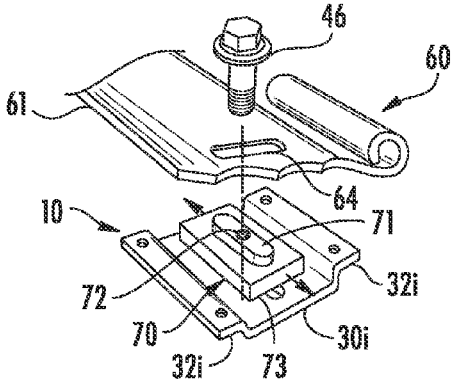
FIG. 42 is a partial exploded perspective view of an exemplary hinge and captive nut assembly including a slotted hinge leaf fastener hole.
Figure 44:
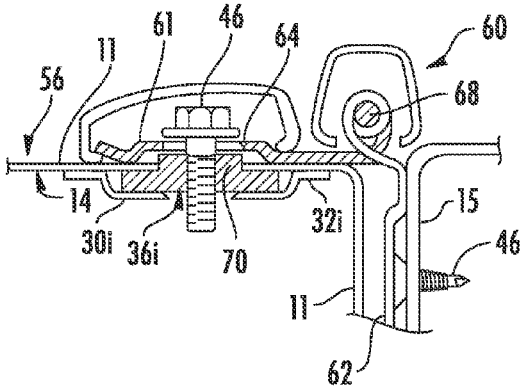
FIG. 44 is a partial cross-sectional view of a door and frame showing all of the components of FIGS. 42 and 43 installed in combination.
Figure 43:
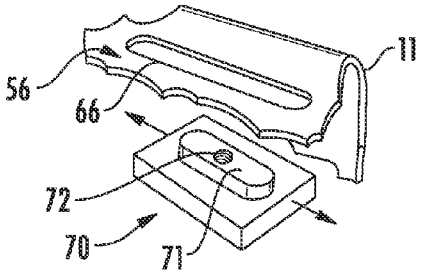
FIG. 43 is a partial exploded perspective view of the captive nut of FIG. 42 shown with a door having an elongated slot-shaped door interior access port useable in the assembly of FIG. 42.

Raised portion 71 on adjusting plate 70 may have any suitable configuration so long as the raised portions is cooperatively configured with elongated slot 66 in door 11 to allow sliding movement of the raised portion in the slot. FIGS. 39 and 40 show one possible embodiment for adjusting plate 70 in which raised portion 71 has a rectangular or square shape and elongated slot 66 in door 11 has a complementary rectangular shape. In FIGS. 42-44, showing an alternative embodiment, raised portion 71 has an elongated shape with rounded ends and elongated slot 66 in door 11 has a complementary shape (it should be noted that the door 11 is not shown in FIG. 42 with hinge 60 for clarity and instead shown separately with adjusting plate 70 in FIG. 43; however, all elements of the captive nut, door, and hinge would be installed together as shown in FIG. 44). Any combination of shaped may be used for raised portions 71 and slots 66 so long as the raised portions are slidable in the slots.

As shown in FIG. 40, adjusting plate 70 in this embodiment would likely have insufficient thickness in raised portion 71 to form threads for receiving a machine screw as shown in the embodiment of FIG. 44. The configuration and added thickness of adjusting plate 70 shown in FIG. 44, however, permits a fastener hole 72 to be provided for accepting a threaded machine screw. In FIG. 40, therefore, a preferably plain hole 72 is provided for receiving a conventional pointed screw as shown or a select tapping screw. Alternatively, the hole 72 may be eliminated entirely if a self tapping screw is to be used as shown in FIG. 46 further described herein.

Figure 46:
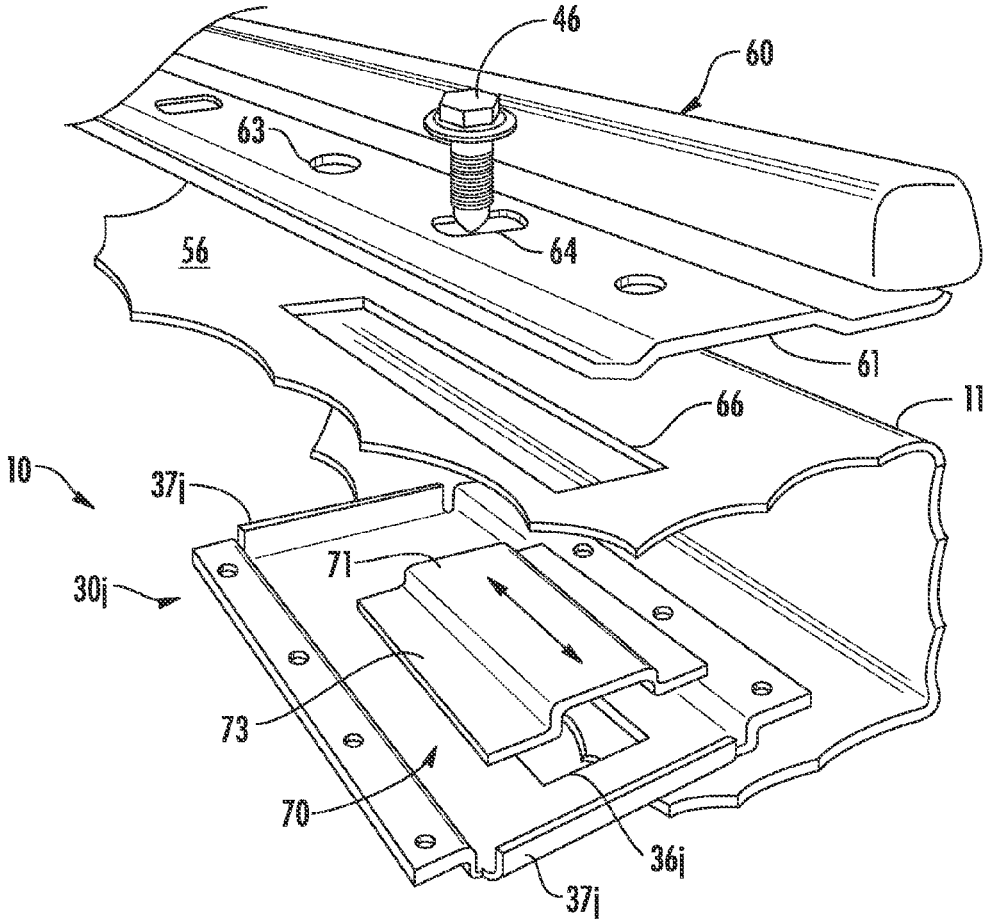
FIG. 46 is a partial exploded perspective view of an exemplary door, hinge and captive nut installation using another embodiment of a captive nut restricted to single axis motion and including an elongated slot-shaped door interior access port and slotted hinge leaf fastener holes.

FIG. 46 shows a possible alternative embodiment of a captive nut 10 having a adjusting plate 70 that is formed as a generally U-shaped member with a raised portion 71 and two opposing flanged portions 73 on either side. In contrast to the adjusting plate 70 shown in FIGS. 39 and 40, raised portion 71 extends along the entire length of adjusting plate 70 from end to end. This shape may be made economically by metal stamping, extrusion, or other methods from a flat metal sheet. In this embodiment, adjusting plate 70 does not include a plain or fastener hole 72, but instead is intended to be used with a threaded fastener 46 preferably in the form of a self-tapping screw as often used in door field installations. However, it will be appreciated that a plain hole 72 for receiving a conventional pointed screw may be furnished in the same manner as already described herein. There likely would be insufficient thickness in raised portion 71 of adjusting plate 70 to form threads for receiving a machine screw as shown in FIG. 44. It will be further noted that holding bracket 30*j* includes inward turned ends 37*j* to assist with retaining adjusting plate 70 in the holding bracket when mounted to door 11 as shown in FIG. 46.

Figure 47:
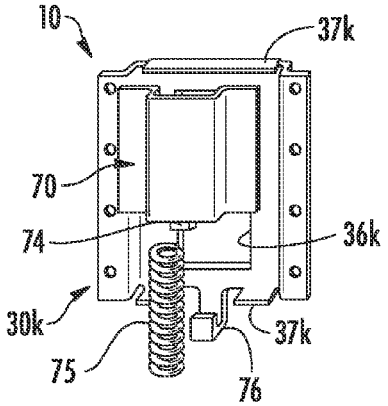
FIG. 47 is an exploded perspective view of an exemplary embodiment of a spring-biased captive nut assembly based on a modified embodiment of the captive nut of FIG. 46.
Figure 48:
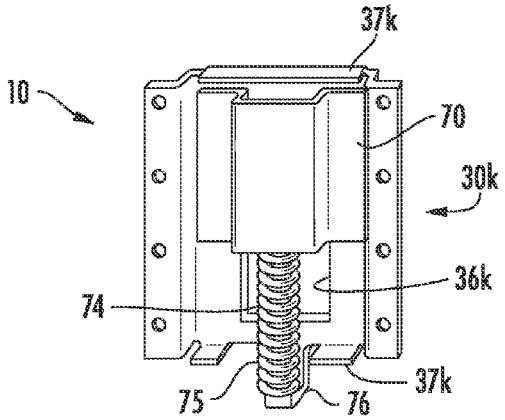
FIG. 48 is an assembled view thereof.
Figure 69:
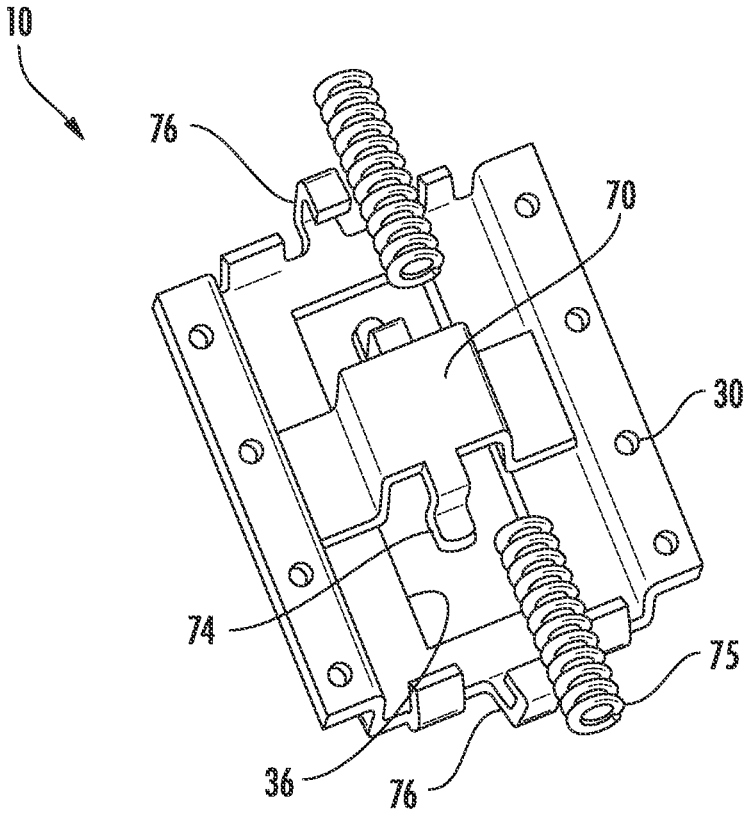
FIG. 69 is an exploded perspective view of an exemplary embodiment of a bi-directional spring-biased captive nut assembly based on a modified embodiment of the captive nut of FIG. 46.

FIGS. 47 and 48 show a modification of the captive nut 10 of FIG. 46 useable in the door and hinge arrangement of FIG. 46, and more particularly a modification of adjusting plate 70 and holding bracket 30*k*. In this embodiment, a spring-biased slidable captive nut 10 is provided having adjusting plate 70 that moves in a single axial direction only (e.g. X-axis or Y-axis) relative to holding bracket 30*k* and slot 66 shown in FIG. 46. In this embodiment, captive nut 10 includes a adjusting plate 70 having a spring retaining tab 74 receiving one end of a spring 75 and a holding bracket having a cooperating spring retaining tab 76 receiving the opposite end of the spring. This arrangement biases adjusting plate 70 in one direction towards one end of holding bracket 30*k* and concomitantly the same corresponding end of slot 66 in door 11 shown in FIG. 46. As opposed to the one-directional spring biased captive nut shown in FIGS. 47 and 48, FIG. 69 shows a bi-directional captive nut 10 having two springs 75 and similar retaining tabs as shown in FIGS. 47 and 48. This embodiment is self-centering and automatically maintains adjusting plate 70 near the middle of holding bracket 30*k* and concomitantly slot 66 in door 11 when the captive nut 10 is mounted to the door.

Figure 50:
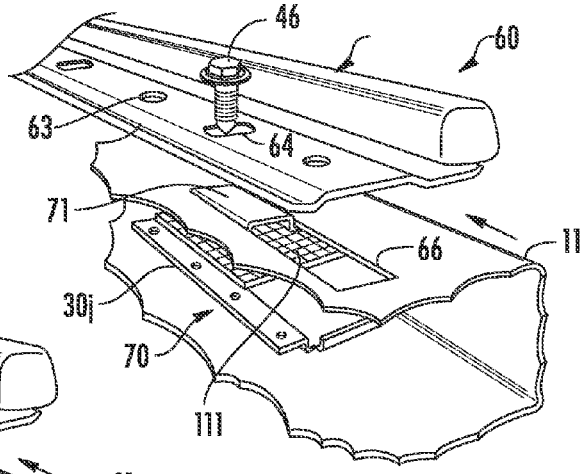
FIG. 50 is a partial exploded perspective view of the door, hinge and captive nut installation of FIG. 46 including a foam insert for maintaining the position of the adjusting plate of the captive nut.
Figure 49:
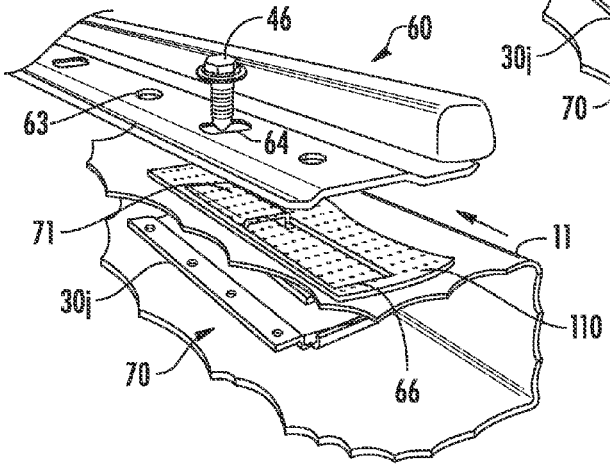
FIG. 49 is a partial exploded perspective view of the door, hinge and captive nut installation of FIG. 46 including tape for maintaining the position of the adjusting plate of the captive nut.
Figure 51:
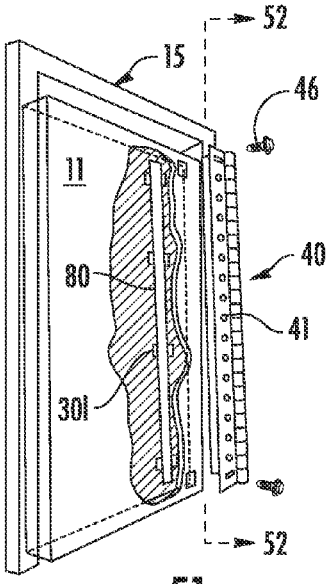
FIG. 51 is a full perspective view of a door having a longitudinally-extending embodiment of a captive nut in the form of a strip according to one exemplary embodiment.
Figure 52:
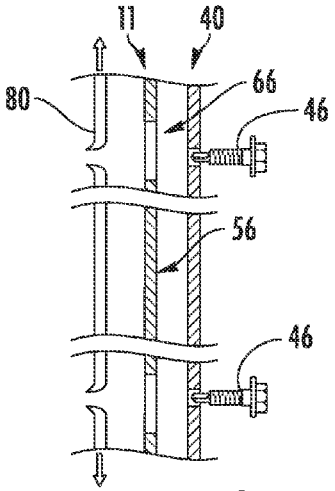
FIG. 52 is a partial cross-sectional side view thereof.
Figure 53:
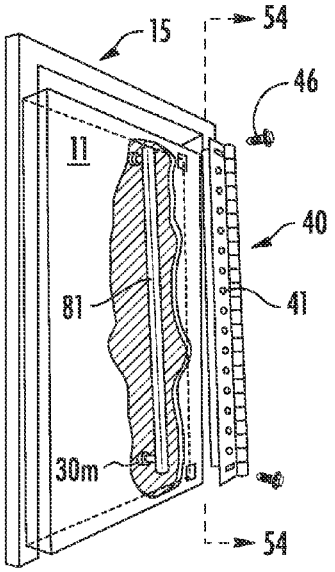
FIG. 53 is a full perspective view of a door having a longitudinally-extending embodiment of a captive nut in the form of a channel according to one exemplary embodiment.
Figure 54:
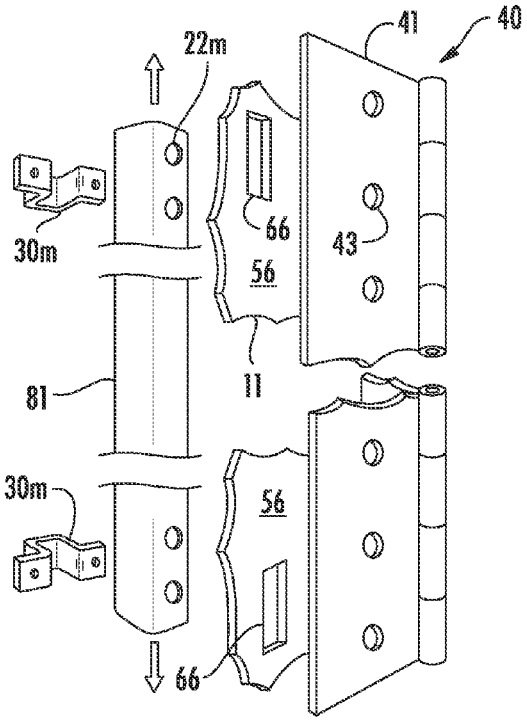
FIG. 54 is a partial cross-sectional side view thereof.
Figure 55:
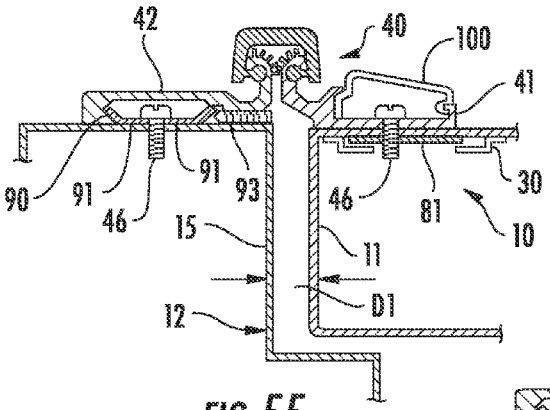
FIGS. 55-57 show a captive nut door and hinge installation with a longitudinally-extending continuous hinge having a frame leaf rail mounting system.
Figure 56:
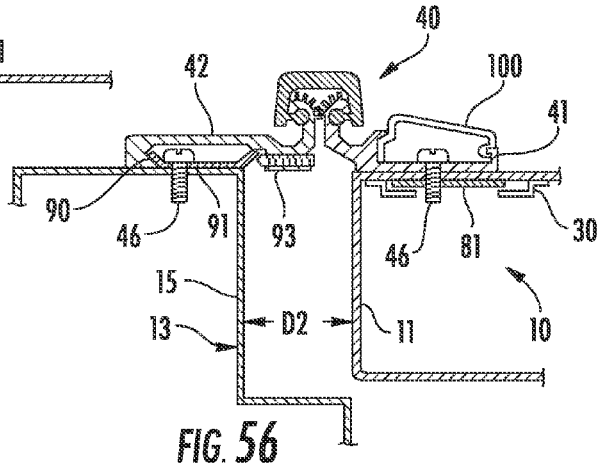
Figure 58:
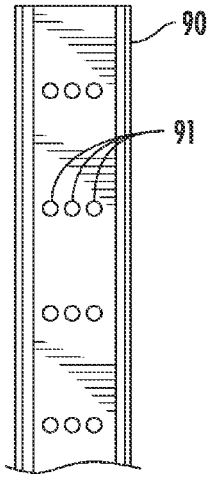
FIG. 58 is a partial front elevation view of the rail of FIGS. 55-57.

FIGS. 49 and 50 show an additional modification of the captive nut 70, door 11, and hinge 60 assembly of FIG. 46. In FIG. 49, captive nut 10 is pre-installed in the factory by the door manufacturer and adjusting plate 70 taped in position with tape 110 for shipping as shown. This keeps the adjusting plate 20*j* in a temporary fixed position until the installer is ready to use the captive nut 10, at which time the tape is severed by the fastener 46 when the slidable plate 20*j* is moved in position relative to the access port 66. Hinge 60 may further be shipped pre-installed and ready for adjustment in the field on the job site. FIG. 50 shows a foam insert 111 preferably installed in the factory for retaining adjusting plate 70 in position for shipping with preinstalled captive nut 10 and serving the same purposes as the tape 110.

Figure 45:
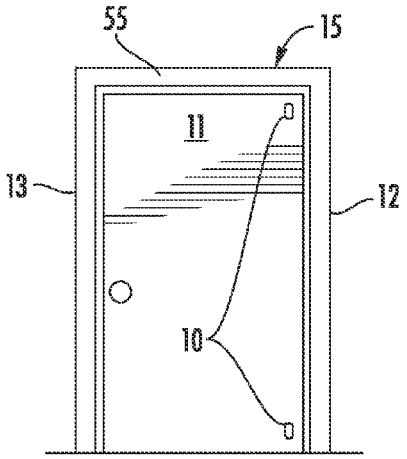
FIG. 45 is a full front elevation view of a door showing preferred exemplary locations for captive nuts.

FIG. 45 shows an exemplary embodiment of a door 11 having a captive nut 10 of any configuration as described herein disposed near the top and bottom hinge side of the door adjacent to but spaced inwards from vertical hinge side frame jamb or section 12. Although this is a preferred minimum number and arrangement for the captive nut 10 assemblies to provide adequate support and adjustability for aligning the door with the frame because both the top and bottom hinge side edges of the door can be held plumb with the frame, it will be appreciated that more or less captive nuts 10 and other mounting locations in door 11 may be used.

FIG. 41 shows an additional embodiment of hinge 60 useable with the captive nuts 10 or and slotted door and hinge combinations shown in FIGS. 35-38, 39-40, and 42-44. The bottom horizontal slot 64 preferably aligns and interacts with the bottom captive nut 10 shown in FIG. 45 for adjusting the door in the X-Y plane according to the methods already as described herein. The captive nuts 10 and slots 64 allow the hinge leaf 61 to be adjusted and moved relative to the door 11. One or more additional horizontal slots 64*a* may be provided as shown that do not interact with a captive nut 10 but instead provide horizontal adjustment of the lockside of door 11 relative to the vertical lockside frame jamb or section 13 according to the methods already as described herein to set the proper lockside door clearance Ch for the locking mechanism to latch and function properly.

FIGS. 51-54 show alternative embodiments of an adjusting plate cooperating with holding brackets 30*l* or 30*m* and door 11 in the form of a slidable longitudinally-extending continuous adjusting strip 80 (FIGS. 51-52) or adjusting channel 82 (FIGS. 53-54) having a length substantially coextensive with the height of the door. Face 56 of door 11 includes vertical slots 66 for receiving fasteners 46 therethrough in a similar manner as shown in FIGS. 36 and 39. The longitudinally-extending adjusting strips 80 and channels are attached via suitably configured holding bracket 30*l* or 30*m* affixed to the interior surface 14 of door 11 which adapted to provide vertical sliding movement relative to the door in the same manner as already described herein. The remaining numbered components/features shown in FIGS. 51-54 and their functionality is also similar to those same components/features already described herein.

Figure 57:
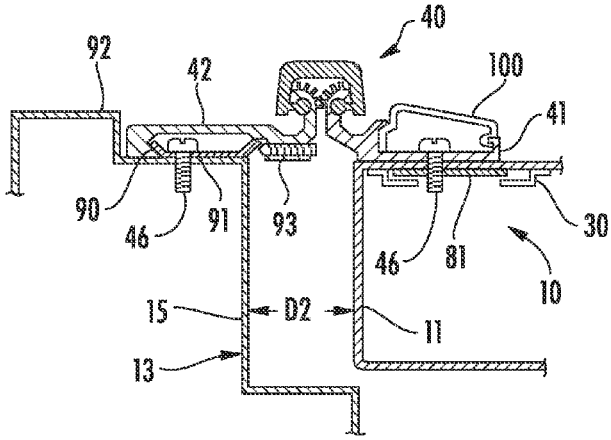

FIGS. 55-57 and 70 show an exemplary application of longitudinally-extending adjusting strip 80 described above as applied to a door mounting system including a hinge 40 with a door leaf 41 as already described herein and a frame leaf 42 using a longitudinally-extending rails system similar to those described in U.S. Pat. No. 6,732,409 to the present inventor, which is incorporated herein by reference in its entirety. Frame leaf 42 is vertically slidable and positionable along rail 90 which is first rigidly fastened to the face of vertical hinge side frame jamb or section 12 of frame 15 via threaded fasteners 46. Once the desired vertical position of hinge leaf 42 is achieved, one or more set screws 93 are used to lock the hinge leaf in position on rail 90 as shown. In this embodiment, with particular reference to FIG. 59, rail 90 may include two or more vertically spaced and horizontally aligned sets of mounting holes 91 to extend the range of lateral hinge leaf 42 and concomitantly door 11 adjustability in relation to the frame 15 depending on the hole selected in each mounting hole set for securing the rail to the frame as shown. This allows the gap or distance D1 or D2 to be adjusted to the desired amount of clearance as shown by comparison in FIGS. 55 and 56 wherein D1 is smaller than D2. FIG. 57 shows an application and advantage of the foregoing arrangement in which the hinge leaf 42 may be set close to a frame corner 92 on a decorative door frame or where frames are laterally narrow. It should be noted that any of the captive nut 10 arrangements and adjusting plate embodiments shown herein may be used alternatively to adjusting strip 80.

Figure 60:
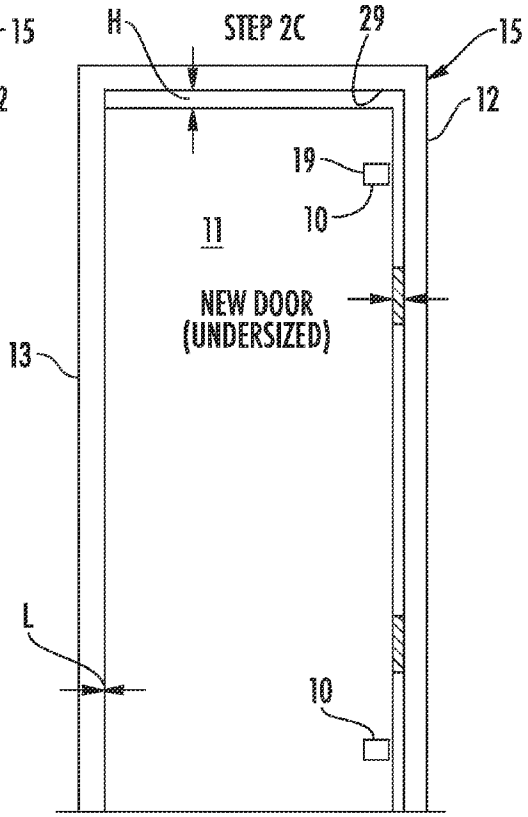
FIGS. 59-67 show an exemplary embodiment of sequential method steps for mounting a door and adjusting the door alignment in a first reference X-Y plane using combined captive nuts and the rail mounted hinge system of FIGS. 55-58.
Figure 59:
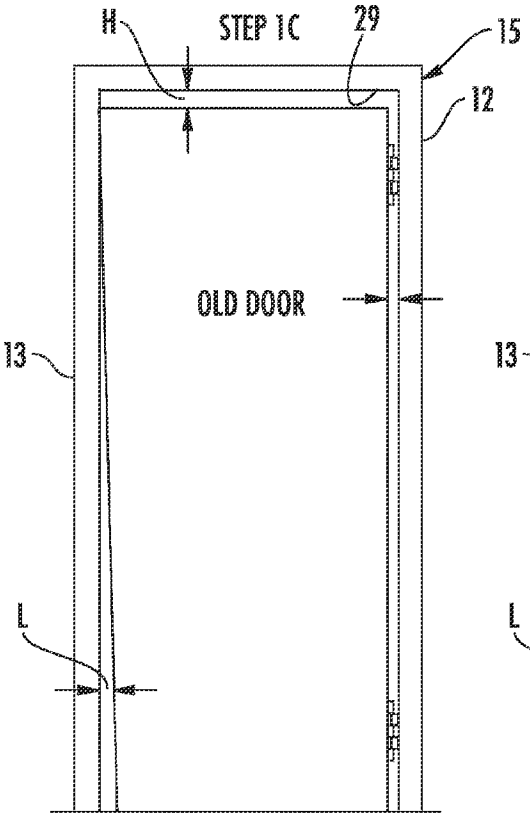
Figure 62:
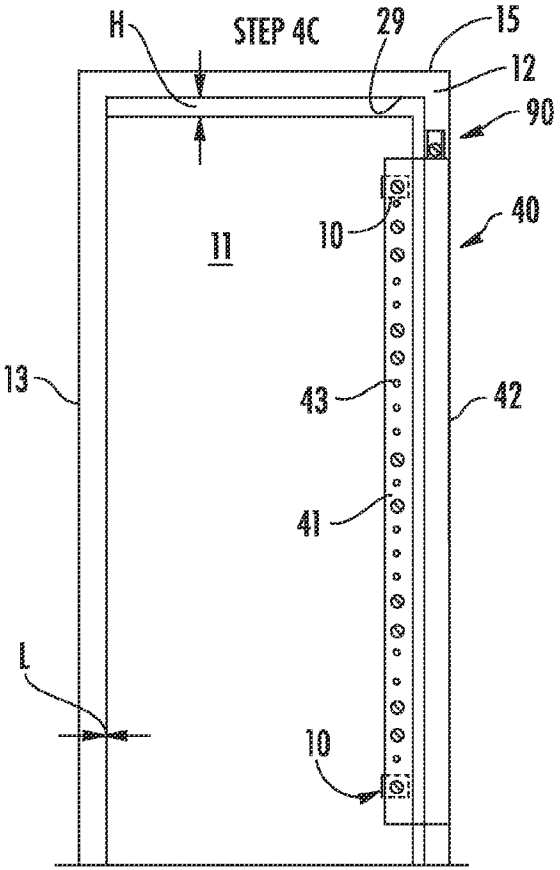
Figure 61:
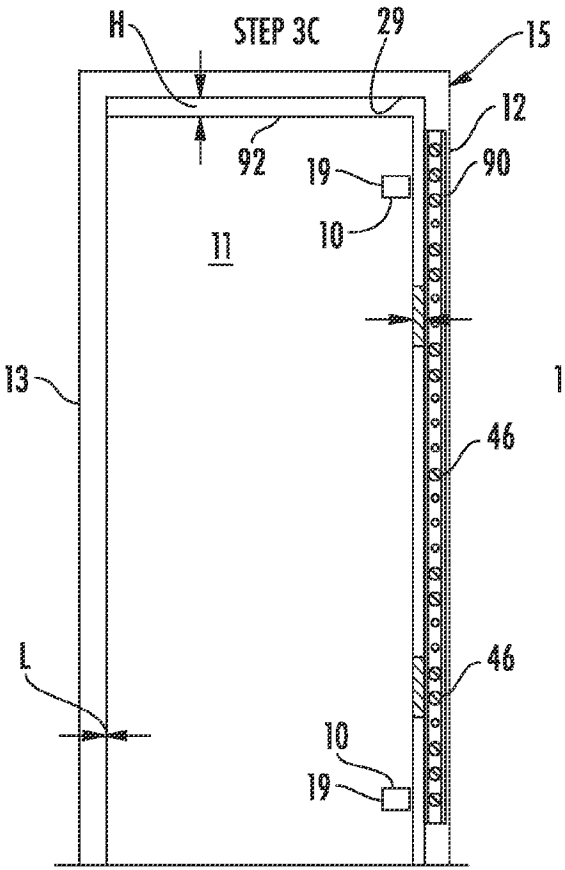
Figure 68:
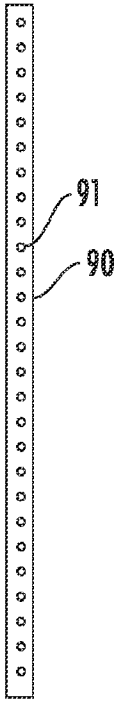
FIG. 68 is a front elevation view of an exemplary rail of the rail mounted hinge system of FIGS. 55-58.

An exemplary method of using the hinge and rail system shown in FIGS. 55-58 will now be described with additional reference to the steps shown in FIGS. 59-67 and FIG. 68. Rail 90 is provided as shown in FIG. 68 for mounting to door frame 15, and more particularly to vertical hinge side frame jamb or section 12 of the frame. Rail 90 includes a plurality of vertically spaced single mounting holes 91 which may be as shown in FIG. 68 or can be arranged in horizontal sets of two or more holes 91 as shown in FIG. 59 and described above. The method begins with first removing the existing door and hinges (Step 1C, FIG. 59) and then placing a new preferably undersized door 11 in the door opening 29 and resting on the floor or threshold (Step 2C, FIG. 60). Door 11 is preferably pushed against vertical lock side frame jamb or section 13 after the door is positioned in the door opening (see FIG. 60). Preferably, door 11 includes at least one, but more preferably two captive nuts 10 disposed near the top and bottom hinge side corners of the door as shown in FIG. 60. Next, rail 90 is rigidly fastened to frame 15 (i.e., vertical hinge side frame jamb or section 12) using threaded fasteners 46 inserted through mounting holes 91 in the rail (Step 3C, FIG. 61). Hinge leaf 42 of hinge 40 is next hoolted over rail 90 and set screws 93 are lightly tightened to hold the hinge leaf in position on the rail but to allow the hinge leaf to slide vertically on the rails in a subsequent step to be described (Step 4C, FIG. 62).

Figures 63, 64, 65:
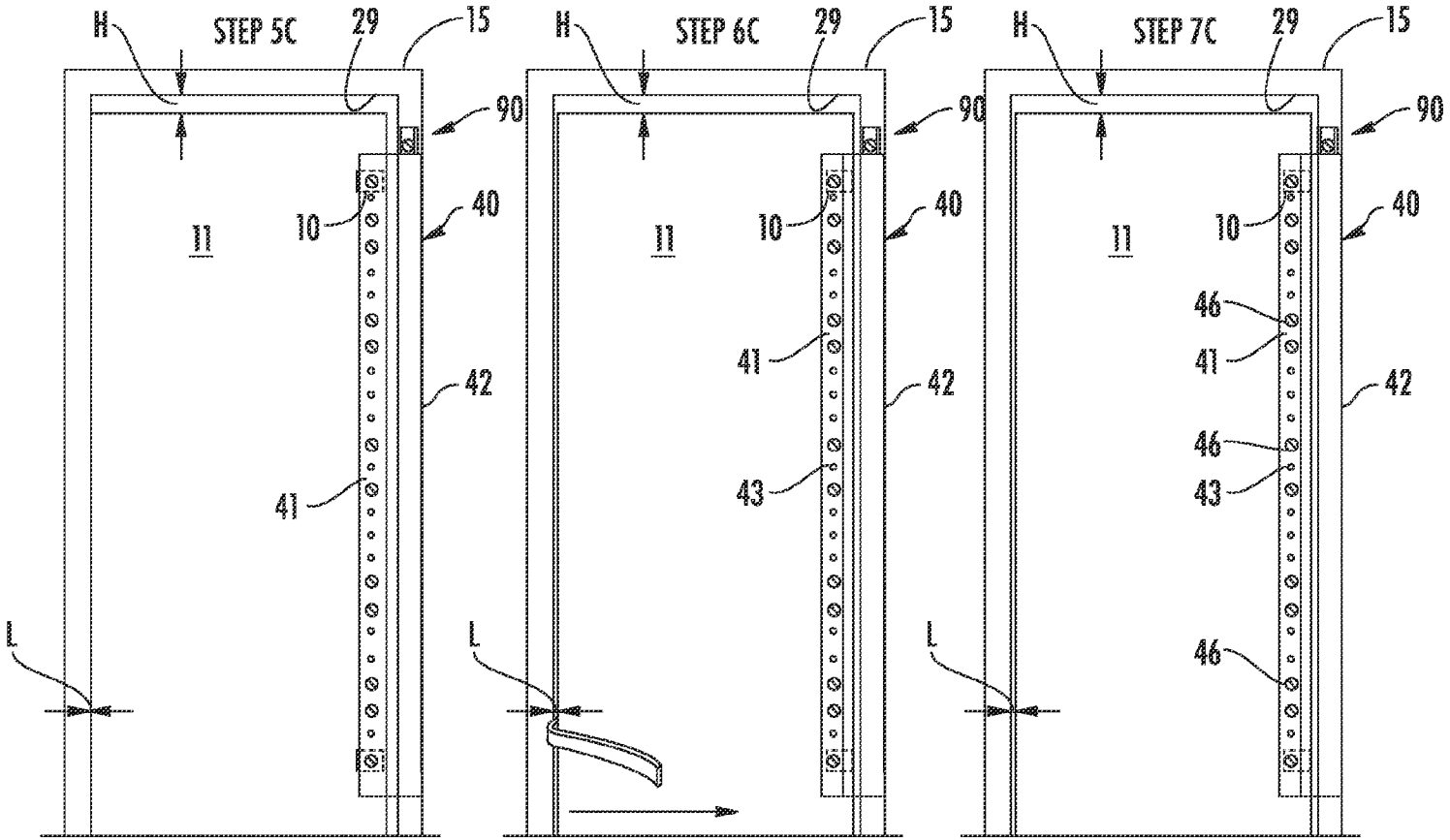
Figure 67:
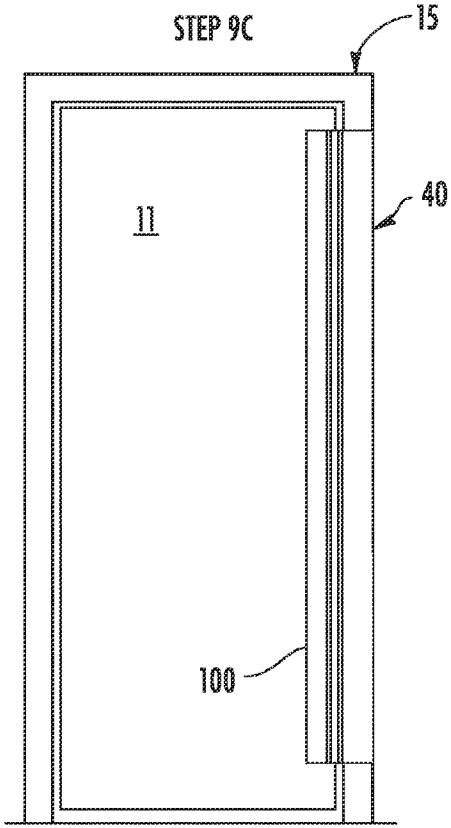
Figure 66:
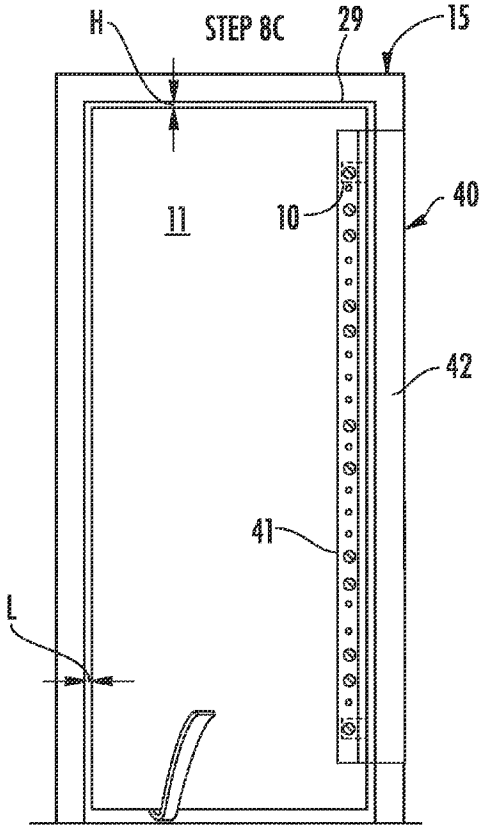

The method continues in FIG. 63 by installing threaded fasteners 46 through mounting holes 43 in door leaf 41 and access ports 19 in door 11 and into adjusting plates 20, adjusting rail 80, or adjusting 81 of captive nuts 10 as described herein depending on the particular type of captive nut provided with the door (Step 5C). Next, the door 11 is pushed towards the vertical hinge side frame jamb or section 12 to set the proper lockside clearance "L" as shown by the directional arrow (Step 6C, FIG. 64). Then, threaded fasteners 46 are installed through mounting holes 43 in door leaf 41 to rigidly secure the leaf to door 11 (Step 7C, FIG. 65). This sets and locks the lockside door clearance. Next, with the hinge leaf 42 still loosely secured to rail 90 from Step 4C, door 11 is raised upwards to set the proper header clearance "H between the top of the door and frame 15 (Step 8C, FIG. 66). As shown in FIG. 66, the loosely secured frame leaf 42 moves vertically upwards on rail 90 wherein the previously visible top of the rail is now preferably covered by the hinge leaf for aesthetic reasons. Next, the set screws 93 are tightly fastened to rails 90 (see also FIG. 55) to lock the hinge leaf 42 in position thereby concomitantly locking the header clearance of the door 11 attached to hinge 40. Finally, with the door now securely mounted in position in frame 15, optional decorative molding 100 may be snapped in place on door leaf 41 to conceal mounting screws 46 (see also FIG. 55) completing the installation as shown in Step 9C, FIG. 67.

Figure 70:
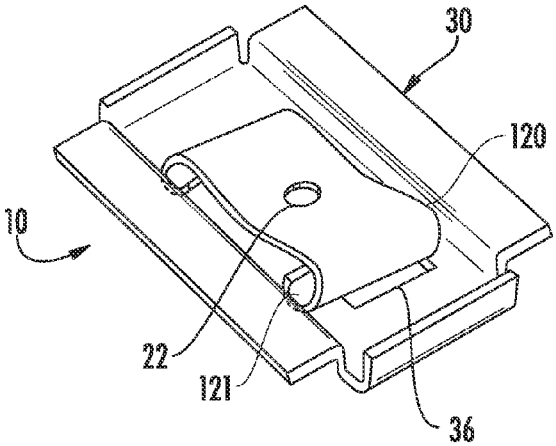
FIGS. 70-71 show a perspective view and cross sectional view respectively of one possible alternative embodiment of a spring biased captive nut.
Figure 71:
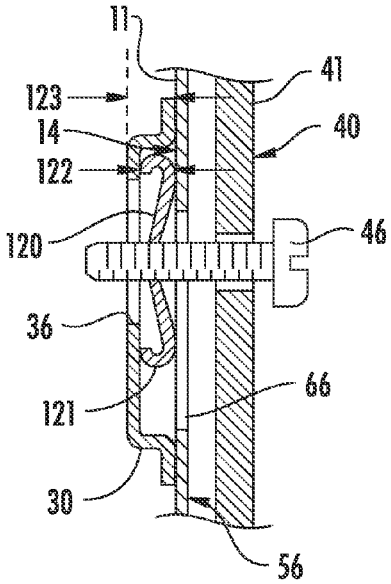

FIGS. 70-73 show alternative embodiments of spring biased captive nuts used in conjunction with a modified version of holding bracket 30*j* shown in FIG. 46 adjusting plate 70, door 11, and hinge 60 assembly of FIG. 46 and fully described herein. In FIGS. 70 and 71, a captive nut 10 is provided with an adjusting plate 120 formed as a resiliently deformable conventional speed nut formed of a spring-like steel material as is well known in the art. Adjusting plate 120 of captive nut 10' has two opposing rolled ends 121 and is biased towards and into engagement with interior surface 14 of door 11 when mounted inholding bracket 30*p* affixed to the door 11. Preferably the depth 123 of the holding bracket 30*p* is less than the height 122 of adjusting plate 120 (measured axially along the shank of threaded fastener 46 as shown in FIG. 71) so as to resiliently compress and spring load the spring-like adjusting plate 120 as shown. This keeps the adjusting plate 120 in a temporary fixed position until the installer is ready to use the captive nut and insert fastener 46 therein as shown. Other numbered components shown are the same as already described herein. Preferably, the access ports 66 in door 11 is elongated as shown and described herein elsewhere to provide a range of adjustability for adjusting plate 120 and to allow an installer to insert a small tool therethrough to raise or lower and position the adjusting plate before hinge 40 is affixed to captive nut 10 in door 11 with threaded fastener 46.

Figure 72:
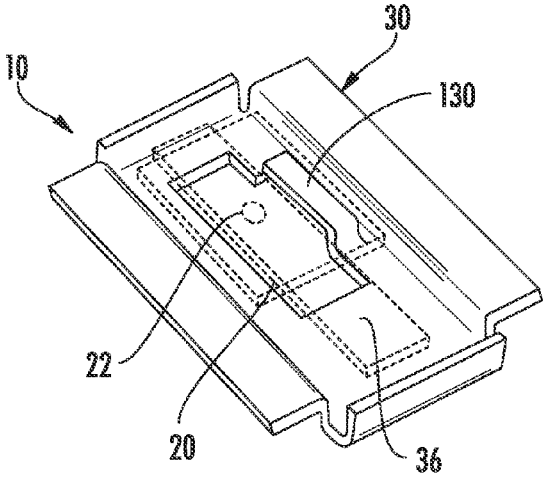
FIGS. 72-73 show a perspective view and cross sectional view respectively of another possible alternative embodiment of a spring biased captive nut.
Figure 73:
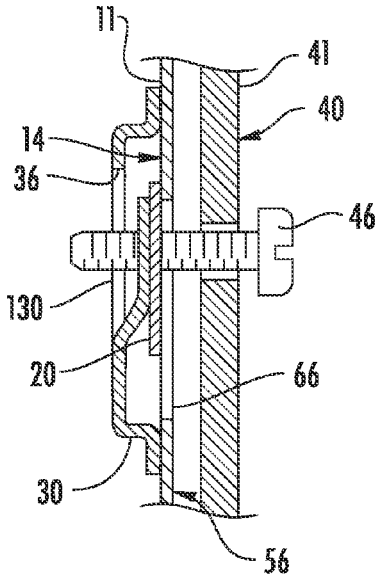

In FIGS. 72-73, the spring biased captive nut 10 includes a holding bracket 30*q* having two resiliently deformable and spaced apart pressure blades 130 offset and extending from the holding bracket as shown. The pressure blades keep adjusting plate 20*q* compresses against and biased towards and into engagement with interior surface 14 of door 11 when mounted in holding bracket 30*q* affixed to the door 11. Adjusting plate 20*q* is preferably flat or planar similar to the embodiment shown in FIG. 3. The pressure blade arrangement serves the same purpose as the speed nut style captive nut embodiment shown in FIGS. 70-71 and described above. Other numbered components shown are the same as already described herein. Preferably, the access ports 66 in door 11 is elongated as shown and described herein elsewhere to provide a range of adjustability for adjusting plate 20*q* and to allow an installer to insert a small tool therethrough to raise or lower and position the adjusting plate before hinge 40 is affixed to captive nut 10 in door 11 with threaded fastener 46.

The foregoing methods described herein of attaching a door to a door frame have the advantage that a new door somewhat narrower in width can be used to fill an existing opening. For example, the half-surface hinge shown in FIG. 9 can easily cover an unusually wide gap, allowing nominal door sizing to be used to replace existing doors in frames of widely varying widths. It also permits the use of robust, fully-headed hinge fasteners in the frame leaf because the door-to-frame clearances can be designed to allow the use of non-countersunk screws if desired. Thicker hinge leaves, including hinges made of extruded aluminum, as well as sheet steel could be used.

Summarizing, this invention advantageously allows for the complete three-dimensional adjustment of a door relative to a new or pre-existing door frame, preferably made undersize to fully utilize the features of these devices and the method of installation in the system as described herein. It will be appreciated that in some embodiments, both adjustable door inserts or captive nuts 10 and frame inserts or captive nuts 10 may be combined to provide three-dimensional adjustability of a door along the X, Y, and Z axes. These may be combined with horizontal and/or vertical slot in the door and/or hinge door and frame leaves as described herein to advantageously provide a versatile door mounting system that can be readily adapted to any number of different installation requirements and used with many different types of hinges and mounting styles such as full surface, half surface, and fully concealed. Accordingly, embodiments of the present invention are not limited in their applicability for use with any particular type of door or hinge installation.

The devices and apparatuses described herein utilize conventional, commercially-available components which will be readily known to and obtainable by those skilled in the art. Therefore, it is well within ambit of those skilled in the art to assemble such components to create these devices and to employ the methods described herein without undue experimentation.

While the foregoing description and drawings represent the preferred embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. An adjustable door mounting system for mounting a door in a frame comprising: an access door; a hinge including a door leaf and a frame leaf pivotally connected together; and a captive nut including a holding bracket and an adjusting plate, the holding bracket being attachable to a surface of the door and comprising two ends and an offset portion extending away from the surface of the door and between two ends of the bracket, the adjusting plate between the offset portion and the surface of the door and bounded by the two ends of the bracket in at least one dimension such that the adjusting plate is movably retained within the bracket, the adjusting plate configured and adapted for receiving a fastener therein inserted through the door leaf wherein the adjusting plate and the door leaf are separated by the surface of the door, and wherein the captive nut is operable to adjust a position of the door relative to the hinge.

2. The door mounting system of claim 1, wherein the door includes a hollow interior portion and wherein said surface is in the hollow interior portion behind an access port formed in the door.

3. The door mounting system of claim 1, wherein the adjusting plate includes a fastener receiving hole.

4. The door mounting system of claim 1, further comprising a threaded fastener inserted through the door leaf and fixedly connected to the adjusting plate, the fastener and adjusting plate being movable in unison together to a plurality of positions for positioning the hinge relative to the door.

5. The door mounting system of claim 1, wherein the hinge is a longitudinally-extending continuous hinge having a length substantially coextensive with a height of the door.

6. The door mounting system of claim 2, wherein the access port has a shape selected from a group consisting of a rectangle, a square, and an elongated slot.

7. The door mounting system of claim 1, wherein the holding bracket includes an aperture for receiving a shank of the fastener therethrough.

8. The door mounting system of claim 1, wherein the adjusting plate is H-shaped, rectangular shaped, or square shaped.

9. The door mounting system of claim 1, wherein the adjusting plate and holding bracket are made of metal.

10. The door mounting system of claim 1, further comprising a second captive nut including a holding bracket attached to a door frame and an adjusting plate movably retained within the bracket of the second captive nut, the adjusting plate of the second captive nut configured and adapted for receiving a second fastener therein inserted through the hinge leaf.

11. An adjustable door mounting system comprising: a door; a door frame attachable to a building superstructure; a hinge including a pair of leaves pivotally connected together for supporting the door; and a captive nut including a holding bracket and an adjusting plate, the holding bracket being attachable to a surface of the door or frame and comprising two ends and an offset portion extending away from said surface and between the two ends of the bracket, the adjusting plate being between the offset portion and said surface and bounded by the two ends of the bracket in at least one dimension such that the adjusting plate is movably retained within the bracket, the adjusting plate configured and adapted for receiving a fastener therein inserted through one of the leaves of the hinge wherein the adjusting plate and said one of the leaves of the hinge receiving the fastener are separated by said surface, and wherein the captive nut is operable for adjusting a position of the door relative to the door frame.

12. The door mounting system of claim 11, wherein the door includes a hollow interior portion and wherein said surface is in the hollow interior portion behind an access port formed in the door.

13. The door mounting system of claim 12, wherein the fastener is inserted through said one of the leaves of the hinge and fixedly connected to the adjusting plate, the fastener and adjusting plate being movable in unison together to a plurality of positions for positioning the hinge relative to the door.

14. The door mounting system of claim 12, wherein the access port has a shape selected from a group consisting of a rectangle, a square, and an elongated slot.

15. The door mounting system of claim 11, wherein the adjusting plate includes a fastener receiving hole.

16. The door mounting system of claim 11, wherein the hinge is a longitudinally-extending continuous hinge have a length substantially coextensive with a height of the door.

* * * * *